US012372238B1

(12) United States Patent
Hahm et al.

(10) Patent No.: US 12,372,238 B1
(45) Date of Patent: Jul. 29, 2025

(54) GAS TURBINE ENGINE COMBUSTOR HAVING A CERAMIC MATRIX COMPOSITE LINER AND DOME

(71) Applicant: General Electric Company, Schenectady, NY (US)

(72) Inventors: Trevor James Hahm, Cincinnati, OH (US); Daniel J. Kirtley, Blue Ash, OH (US); Scott M. Bush, Liberty Township, OH (US); Adam Robert Kahn, Mason, OH (US); Shai Birmaher, Cincinnati, OH (US); Ryan Christopher Jones, West Chester, OH (US); Nathan Richard Hermanson, Cincinnati, OH (US); Gerardo Antonio Salazar Lois, West Chester, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/604,906

(22) Filed: Mar. 14, 2024

(51) Int. Cl.
*F23R 3/00* (2006.01)

(52) U.S. Cl.
CPC .... *F23R 3/002* (2013.01); *F23R 2900/00012* (2013.01)

(58) Field of Classification Search
CPC .. F23R 3/007; F23R 3/60; F23R 3/002; F05D 2240/90
See application file for complete search history.

(56) References Cited

U.S. PATENT DOCUMENTS

| | | | | |
|---|---|---|---|---|
| 6,895,757 | B2 | 5/2005 | Mitchell et al. | |
| 6,904,757 | B2 * | 6/2005 | Mitchell | F23R 3/60 60/800 |
| 7,044,709 | B2 | 5/2006 | Bruce et al. | |
| 8,556,531 | B1 | 10/2013 | Bird et al. | |
| 8,745,819 | B2 | 6/2014 | Embler | |
| 9,976,746 | B2 * | 5/2018 | Bloom | F23R 3/002 |
| 10,197,278 | B2 | 2/2019 | Bloom et al. | |
| 10,281,153 | B2 | 5/2019 | Hannwacker et al. | |
| 10,378,771 | B2 | 8/2019 | Hannwacker et al. | |
| 10,663,167 | B2 * | 5/2020 | Dziech | F23M 5/04 |
| 10,801,729 | B2 * | 10/2020 | Bloom | F23R 3/60 |
| 11,092,076 | B2 | 8/2021 | Wang et al. | |
| 11,662,096 | B2 * | 5/2023 | Salazar Lois | F23R 3/002 60/722 |
| 11,725,814 | B2 | 8/2023 | Stieg et al. | |
| 2002/0184886 | A1 * | 12/2002 | Calvez | F23R 3/60 60/804 |

(Continued)

FOREIGN PATENT DOCUMENTS

CN 117917530 A * 4/2024 ..... F02C 7/20

*Primary Examiner* — Craig Kim
(74) *Attorney, Agent, or Firm* — Venable LLP; Edward A. Kmett; Michele V. Frank

(57) ABSTRACT

A combustor for a gas turbine engine includes a ceramic matrix composite (CMC) dome structure, a CMC outer liner, a CMC inner liner, and a cowl structure, that are connected together via at least one outer connection and at least one inner connection. An outer seal member is arranged to seal an outer gap between an outer liner connecting flange and an outer dome connecting flange, and an inner seal member is arranged to seal an inner gap between an inner liner connecting flange and an inner dome connecting flange.

18 Claims, 14 Drawing Sheets

(56) References Cited

U.S. PATENT DOCUMENTS

| | | | | |
|---|---|---|---|---|
| 2008/0034759 | A1* | 2/2008 | Bulman | F02C 3/14 60/796 |
| 2020/0158341 | A1* | 5/2020 | Bloom | F23R 3/60 |
| 2022/0268443 | A1 | 8/2022 | Bilse et al. | |
| 2023/0112117 | A1* | 4/2023 | Salazar Lois | F23R 3/007 60/722 |
| 2024/0053009 | A1* | 2/2024 | Ganiger | F02C 7/00 |

* cited by examiner

GAS TURBINE ENGINE COMBUSTOR HAVING A CERAMIC MATRIX COMPOSITE LINER AND DOME

TECHNICAL FIELD

The present disclosure relates to a gas turbine engine combustor having a CMC (ceramic matrix composite) liner and a CMC dome connected to a cowl structure.

BACKGROUND

Gas turbine engines generally include a combustor. The combustor may be an annular combustor that includes a combustor liner, which may include an outer liner and an inner liner that are connected to a dome, with a combustion chamber being defined between the inner liner and the outer liner. The outer liner and the inner liner may also be connected to a cowl structure. The cowl structure may generally be a metallic structure, while, in some cases, the outer liner and the inner liner may be formed of a CMC material. In some cases, the dome may also be formed of a CMC material.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Figure 1:
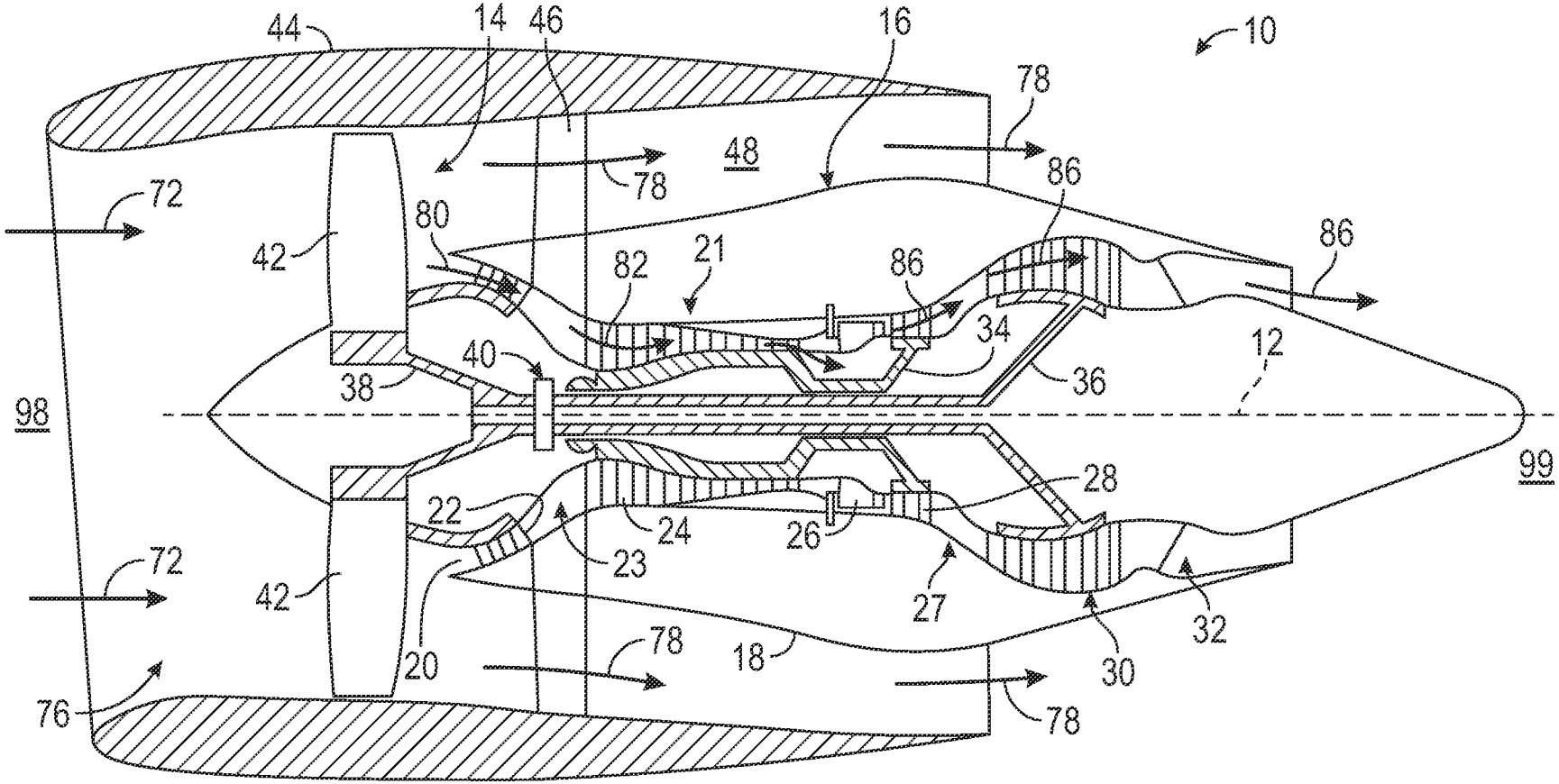
FIG. 1 is a schematic partial cross-sectional side view of an exemplary high by-pass turbofan jet engine, according to an aspect of the present disclosure.

Features, advantages, and embodiments of the present disclosure are set forth or apparent from a consideration of the following detailed description, drawings, and claims. Moreover, the following detailed description is exemplary and intended to provide further explanation without limiting the disclosure as claimed.

Various embodiments are discussed in detail below. While specific embodiments are discussed, this is done for illustration purposes only. A person skilled in the relevant art will recognize that other components and configurations may be used without departing from the present disclosure.

As used herein, the terms "first" and "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "outer" and "inner" refer to the relative direction with respect to a radial direction extending outward from a centerline axis. For example, "outer" refers to an element or a part of an element (e.g., a side of an element) further away from the centerline axis in the radial direction, and "inner" refers to an element or a part of an element (e.g., a side of an element) closer to the centerline axis in the radial direction.

The terms "outward" and "inward" refer to the relative direction with respect to the radial direction extending from a defined part of an element. For example, "outward" refers to a direction extending radially from the defined part of the element away from the centerline axis in the radial direction. The term "inward" refers to a direction extending radially from the defined part of the element toward the centerline axis in the radial direction.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

The singular forms "a," "an," and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially" is not to be limited to the precise value specified. In at least some instances, the approximating language may correspond to the precision of an instrument for measuring the value, or the precision of the methods or the machines for constructing or manufacturing the components and/or systems. For example, the approximating language may refer to being within a one, two, four, ten, fifteen, or twenty percent margin in either individual values, range(s) of values, and/or endpoints defining range(s) of values.

Here and throughout the specification and claims, range limitations are combined and interchanged. Such ranges are identified and include all the sub-ranges contained therein unless context or language indicates otherwise. For example, all ranges disclosed herein are inclusive of the endpoints, and the endpoints are independently combinable with each other.

The term "composite," as used herein, is indicative of a material having two or more constituent materials. A composite can be a combination of at least two or more metallic, non-metallic, or a combination of metallic and non-metallic elements or materials. Examples of a composite material can be, but not limited to, a polymer matrix composite (PMC), a ceramic matrix composite (CMC), a metal matrix composite (MMC). The composite may be formed of a matrix material and a reinforcing element, such as a fiber (referred to herein as a reinforcing fiber).

As used herein, CMC (or Ceramic Matrix Composite) refers to a class of materials with reinforcing fibers in a ceramic matrix. Generally, the reinforcing fibers provide structural integrity to the ceramic matrix. Some examples of reinforcing fibers can include, but are not limited to, non-oxide silicon-based materials (e.g., silicon carbide, silicon nitride, or mixtures thereof), non-oxide carbon-based materials (e.g., carbon), oxide ceramics (e.g., silicon oxycarbides, silicon oxynitrides, aluminum oxide ($Al_2O_3$), silicon dioxide ($SiO_2$), aluminosilicates such as mullite, or mixtures thereof), or mixtures thereof.

Some examples of ceramic matrix materials can include, but are not limited to, non-oxide silicon-based materials (e.g., silicon carbide, silicon nitride, or mixtures thereof), oxide ceramics (e.g., silicon oxycarbides, silicon oxynitrides, aluminum oxide ($Al_2O_3$), silicon dioxide ($SiO_2$), aluminosilicates, or mixtures thereof), or mixtures thereof. Optionally, ceramic particles (e.g., oxides of Si, Al, Zr, Y, and combinations thereof) and inorganic fillers (e.g., pyrophyllite, wollastonite, mica, talc, kyanite, and montmorillonite) can also be included within the ceramic matrix.

Generally, particular CMCs can be referred to by their combination or type of fiber/type of matrix. For example, C/SiC for carbon-fiber-reinforced silicon carbide, SiC/SiC for silicon carbide-fiber-reinforced silicon carbide, SiC/SiN for silicon carbide fiber-reinforced silicon nitride, SiC/SiC—SiN for silicon carbide fiber-reinforced silicon carbide/silicon nitride matrix mixture, etc. In other examples, the CMCs can be comprised of a matrix and reinforcing fibers comprising oxide-based materials such as aluminum oxide ($Al_2O_3$), silicon dioxide ($SiO_2$), aluminosilicates, and mixtures thereof. Aluminosilicates can include crystalline materials such as mullite ($3Al_2O_3 \cdot 2SiO_2$), as well as glassy aluminosilicates.

In certain non-limiting examples, the reinforcing fibers may be bundled (e.g., form fiber tows) and/or coated prior to inclusion within the matrix. The bundles of fibers may be impregnated with a slurry composition prior to forming the preform or after formation of the preform. The preform may then undergo thermal processing, and subsequent chemical processing to arrive at a component formed of a CMC material having a desired chemical composition. For example, the preform may undergo a cure or a burn-out to yield a high char residue in the preform, and subsequent melt-infiltration with silicon, or a cure or a pyrolysis to yield a silicon carbide matrix in the preform, and subsequent chemical vapor infiltration with silicon carbide. Additional steps may be taken to improve densification of the preform, either before or after chemical vapor infiltration, by injecting the preform with a liquid resin or a polymer followed by a thermal processing step to fill the voids with silicon carbide. CMC material as used herein may be formed using any known or hereafter developed methods including but not limited to melt infiltration, chemical vapor infiltration, polymer impregnation pyrolysis (PIP), or any combination thereof.

The term "metallic" as used herein is indicative of a material that includes metal such as, but not limited to, titanium, iron, aluminum, stainless steel, and nickel alloys. A metallic material or an alloy can be a combination of at least two or more elements or materials, where at least one is a metal.

Gas turbine engines generally include combustor. The combustor may be an annular combustor that includes a combustor liner, which may include an outer liner and an inner liner, that are connected to a dome, with a combustion chamber being defined between the inner liner and the outer liner. The outer liner and the inner liner may also be connected to a cowl structure. The cowl structure may generally be a metallic structure, while, in some cases, the outer liner and the inner liner may be formed of a CMC material. In some cases, the dome may also be formed of a CMC material. In connecting the outer liner, the inner liner, the dome, and the cowl structure together, bolted joints may generally be used, and gaps are present between the various components. In operation of the gas turbine engine, leakage airflow can flow through the gaps of the connection into the combustion chamber. The leakage airflow, however, reduces the total amount of air that is available in the combustor for other purposes, such as for dilution of combustion gases, or for cooling of the combustor.

The present disclosure provides a technique to reduce airflow leakage through the connections between the outer liner, the inner liner, the cowl structure, and the dome by including a seal member within a seal cavity at the connection. In particular, in combustors that implement CMC liners and a CMC dome structure, while the cowl structure is metallic, the use of the CMC materials, which have a lower coefficient of thermal expansion than metallic materials, results in both lower absolute and relative radial motion between adjacent CMC components compared to that of a CMC component being adjacent to a metallic component. By implementing a seal within a cavity residing between interfacing CMC components, and by locating the cavity downstream of the connection features (e.g., a connecting bolt), the amount of leakage airflow through the connection can be better controlled to reduce the airflow leakage through the connections into the combustion chamber, thereby providing for additional air to be available within the combustor for other purposes.

FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine-based turbine engines, industrial turbine engines, and auxiliary power units. The present disclosure is also applicable to unducted fan (or open rotor) turbine engines. As shown in FIG. 1, the engine 10 has a longitudinal centerline axis 12 that extends therethrough from an upstream end 98 to a downstream end 99 for reference purposes. In general, the engine 10 may include a fan assembly 14 and a turbo-engine 16 disposed downstream from the fan assembly 14.

The turbo-engine 16 may generally include an outer casing 18 that defines an annular inlet 20 to a core airflow path 23 of the turbo-engine 16. The outer casing 18 encases, or at least partially forms, in serial flow relationship, a compressor section 21 having a low pressure compressor (LPC) 22 and a high pressure compressor (HPC) 24, a combustion section 26, a turbine section 27 including a high pressure turbine (HPT) 28 and a low pressure turbine (LPT) 30, and a jet exhaust nozzle section 32. A high pressure rotor shaft 34 drivingly connects the HPT 28 to the HPC 24. A low pressure rotor shaft 36 drivingly connects the LPT 30 to the LPC 22. The low pressure rotor shaft 36 may also be connected to a fan shaft 38 of the fan assembly 14. In particular embodiments, as shown in FIG. 1, the low pressure rotor shaft 36 may be connected to the fan shaft 38 by way of a reduction gearbox 40, such as in an indirect-drive or a geared-drive configuration.

As shown in FIG. 1, the fan assembly 14 includes a plurality of fan blades 42 that are coupled to, and that extend radially outwardly from, the fan shaft 38. An annular fan casing or a nacelle 44 circumferentially surrounds the fan assembly 14 and/or at least a portion of the turbo-engine 16. The nacelle 44 may be supported relative to the turbo-engine 16 by a plurality of circumferentially spaced outlet guide vanes (or struts) 46. Moreover, at least a portion of the nacelle 44 may extend over an outer portion of the turbo-engine 16 so as to define a bypass airflow passage 48 therebetween.

Figure 2:
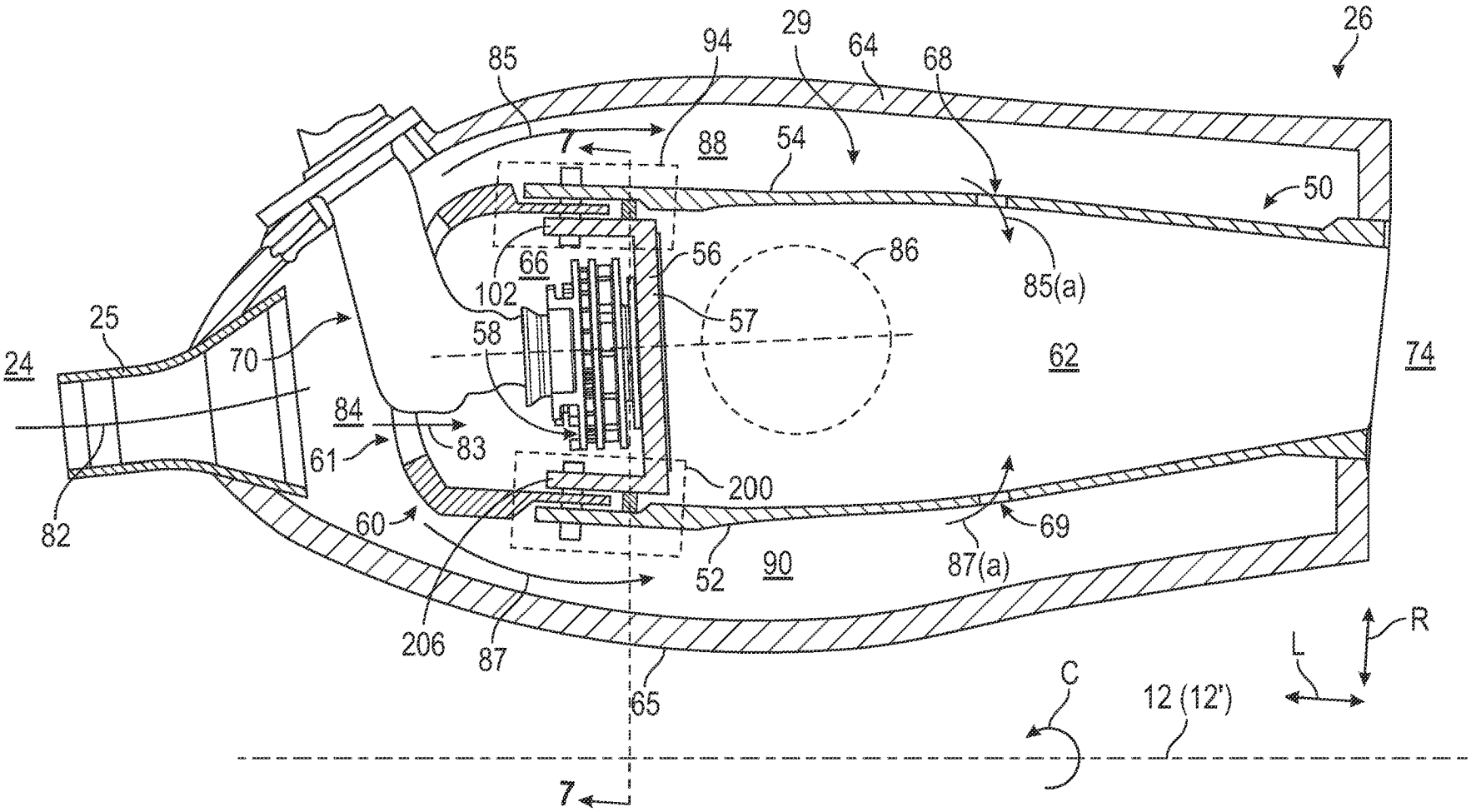
FIG. 2 is a partial cross-sectional side view of an exemplary combustor, according to an aspect of the present disclosure.

FIG. 2 is a partial cross-sectional side view of an exemplary combustion section 26 of the turbo-engine 16 as shown in FIG. 1, according to an aspect of the present disclosure. The exemplary combustion section 26 shown in FIG. 2 is an annular type combustion section that extends circumferentially about a combustor centerline axis 12', which is congruent with the longitudinal centerline axis 12 of the engine 10. While the combustion section 26 is annular about the combustor centerline axis 12', only an upper portion of the combustion section 26 is shown in the cross-sectional view of FIG. 2. As used hereafter, the terms "outer" and "inner" are with respect to the combustor centerline axis 12' such that, for example, an outer element is further away in the radial direction R from the combustor centerline axis 12' than an inner element. The combustion section 26 includes an annular combustor outer casing 64 and an annular combustor inner casing 65 that surround a combustor 29. The combustor 29 includes an annular combustor liner 50 arranged between the annular combustor outer casing 64 and the annular combustor inner casing 65. As shown in FIG. 2, the annular combustor liner 50 includes an annular CMC inner liner 52, and an annular CMC outer liner 54, each of which extends circumferentially about the combustor centerline axis 12' so as to be annular liners. The CMC outer liner 54 and the CMC inner liner 52 may be either a single piece liner, or may be constructed of a plurality of individual sections that may be connected together so as to form the annular liner. Each of the annular CMC outer liner 54 and the annular CMC inner liner 52 is constructed of a CMC material. A CMC dome structure 56 includes a dome plate 57 that extends between an outer dome connecting flange 102 and an inner dome connecting flange 206 of the CMC dome structure 56. The CMC dome structure 56 extends between the CMC outer liner 54 and the CMC inner liner 52, and the CMC dome structure 56 also extends circumferentially about the combustor centerline axis 12' so as to define an annular dome structure. The CMC dome structure 56 may be either a single piece dome structure, or may be constructed of a plurality of individual sections that may be connected together so as to form the annular CMC dome structure 56.

As will be described in more detail below, the CMC inner liner 52 and the CMC outer liner 54 are connected to the CMC dome structure 56, thereby defining a combustion chamber 62 therebetween. The CMC inner liner 52 and the CMC outer liner 54 extend from the CMC dome structure 56 to a turbine nozzle 74 (depicted generally) at an entry to the HPT 28 (FIG. 1), thus, at least partially defining a hot gas path between the CMC dome structure 56 and the HPT 28. In addition, as will be described in more detail below, a cowl structure 60 is connected to the CMC inner liner 52, to the CMC outer liner 54, and to the CMC dome structure 56, thereby defining a pressure plenum 66 therewithin. The cowl structure 60 extends circumferentially about the combustor centerline axis 12', and may be constructed as a single piece cowl structure, or may constitute a plurality of individual cowl sections that are connected together so as to form an annular cowl structure 60. The cowl structure 60 may generally be constructed of a metallic material.

The combustion section 26 further includes a plurality of swirler assemblies 58 (one shown in FIG. 2) that are connected to the CMC dome structure 56 through respective openings in the dome plate 57 of the CMC dome structure 56. In addition, a plurality of fuel nozzle assemblies 70 (one shown in FIG. 2) are connected to the combustor outer casing 64, and each fuel nozzle assembly 70 extends through a respective cowl opening 61 in the cowl structure 60, and is connected with a respective swirler assembly 58.

As shown in FIG. 2, the combustion section 26 includes a diffusor 25, and the combustor outer casing 64 and the combustor inner casing 65 are connected to the diffusor 25. The diffusor 25 is in fluid communication with the HPC 24, and, as will be described below, provides a flow of compressed air 82 into a plenum 84 defined between the combustor outer casing 64 and the combustor inner casing 65. The combustor outer casing 64 and the combustor inner casing 65 also surround the combustor liner 50, and define an outer flow passage 88 between the combustor outer casing 64 and the CMC outer liner 54, and an inner flow passage 90 between the combustor inner casing 65 and the CMC inner liner 52. The CMC outer liner 54 may include a plurality of dilution openings 68 (one shown in FIG. 2) therethrough, and the CMC inner liner 52 may include a plurality of dilution openings 69 (one shown in FIG. 2) therethrough. The dilution openings 68 provide fluid communication through the CMC outer liner 54 between the outer flow passage 88 and the combustion chamber 62, and the dilution openings 69 provide fluid communication through the CMC inner liner 52 between the inner flow passage 90 and the combustion chamber 62.

Referring collectively to FIGS. 1 and 2, during operation of the engine 10, a volume of air 72, as indicated schematically by arrows, enters the engine 10 from the upstream end 98 through an associated nacelle inlet 76 of the nacelle 44 and/or the fan assembly 14. As the air 72 passes across the fan blades 42, a portion of the air 72 is propelled by the fan blades 42 through the fan assembly 14, and is directed or routed into the bypass airflow passage 48 as a bypass airflow 78. Another portion of the air 72 is directed or routed into the LPC 22 via the annular inlet 20 as a compressor inlet air 80. The compressor inlet air 80 is progressively compressed by the LPC 22 and the HPC 24 to form the compressed air 82 as the compressor inlet air 80 flows from the annular inlet 20 through the LPC 22 and the HPC 24 towards the combustion section 26. As shown in FIG. 2, the compressed air 82 flows through the diffusor 25 and into the plenum 84 of the combustion section 26 to pressurize the plenum 84. A first portion of the compressed air 82 in the plenum 84, as indicated schematically by an arrow denoting compressed air 83, flows from the plenum 84 through the cowl opening 61 into the pressure plenum 66 of the cowl structure 60. The compressed air 83 in the pressure plenum 66 flows through the swirler assemblies 58, where the compressed air 83 is mixed with fuel provided by the fuel nozzle assemblies 70 to the swirler assemblies 58 to generate a fuel-air mixture. The fuel-air mixture is then ejected from the swirler assemblies 58 into the combustion chamber 62, and the fuel-air mixture is ignited by an ignitor (not shown) and burned within the combustion chamber 62 to generate combustion gases 86 within the combustion chamber 62.

A second portion of the compressed air 82 in the plenum 84, as indicated schematically by arrows denoting compressed air 85 and compressed air 87, may be routed into the outer flow passage 88, and into the inner flow passage 90, respectively. A portion of the compressed air 85 flowing through the outer flow passage 88, shown schematically as compressed air 85(*a*), may be routed through the plurality of dilution openings 68 of the CMC outer liner 54 into the combustion chamber 62 to provide quenching of the combustion gases 86. Similarly, a portion of the compressed air 87 flowing through the inner flow passage 90, shown schematically as compressed air 87(*a*), may be routed through the plurality of dilution openings 69 of the CMC inner liner 52 into the combustion chamber 62 to provide quenching of the combustion gases 86.

Referring still to FIGS. 1 and 2 collectively, the combustion gases 86 generated in the combustion chamber 62 flow into the HIPT 28 (FIG. 1) via the turbine nozzle 74 (FIG. 2), thus causing the HIPT 28 to rotate, which drives the high pressure rotor shaft 34, thereby driving the HPC 24 to support operation of the HPC 24. As shown in FIG. 1, the combustion gases 86 are then routed from the HPT 28 to the LPT 30, thereby causing the LPT 30 to rotate, which drives the low pressure rotor shaft 36, thereby driving the LPC 22 to support operation of the LPC 22 and/or rotation of the fan shaft 38 via the reduction gearbox 40. The combustion gases 86 are then exhausted through the jet exhaust nozzle section 32 of the turbo-engine 16 to provide propulsion at the downstream end 99 of the engine 10.

Figure 3:
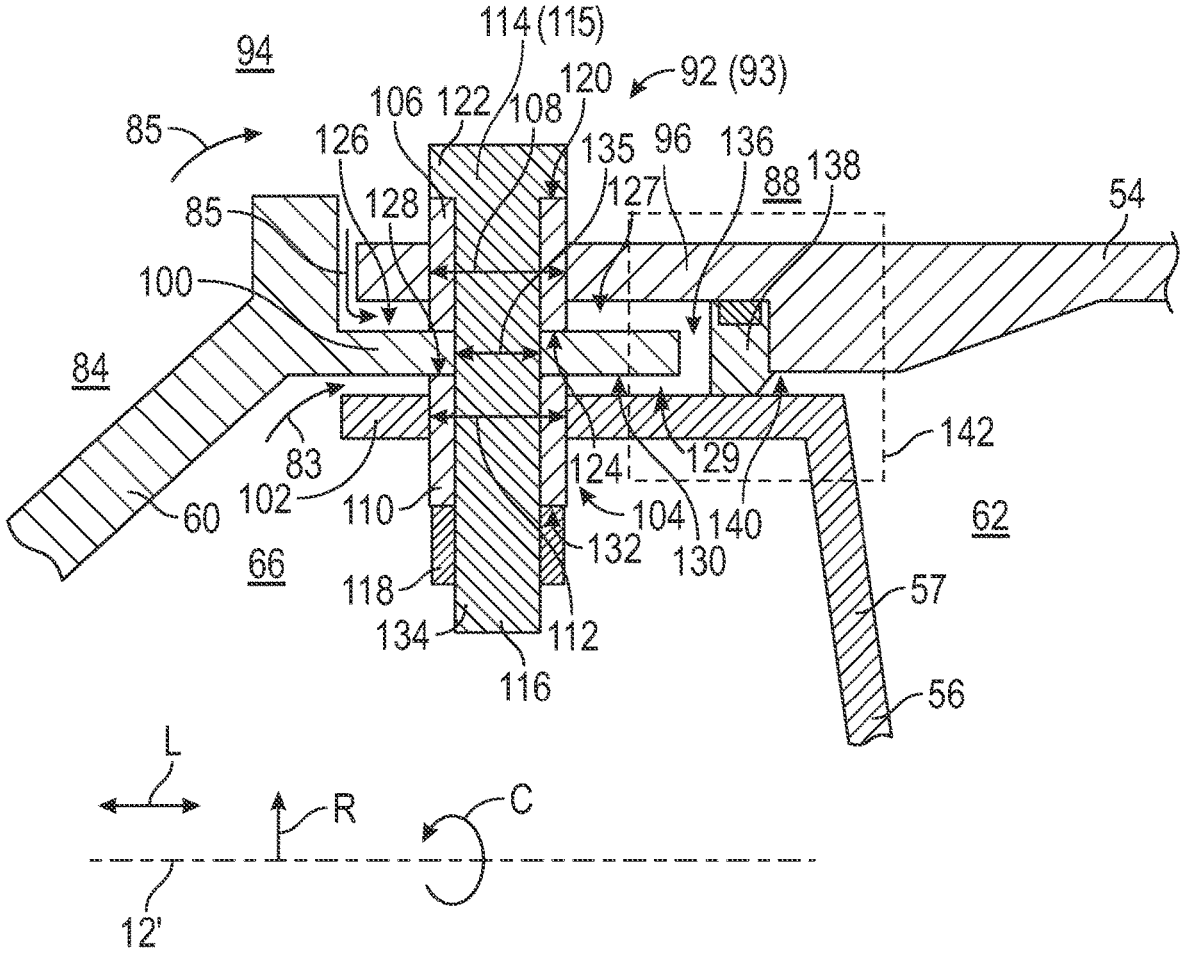
FIG. 3 is an enlarged partial cross-sectional side view of an outer connection, taken at detail view 94 of FIG. 2, according to an aspect of the present disclosure.

FIG. 3 is an enlarged partial cross-sectional side view of an outer connection 92, taken at detail view 94 of FIG. 2, according to an aspect of the present disclosure. As will be explained in more detail below, the outer connection 92 is a bolted outer joint 93. In FIG. 3, the CMC outer liner 54 includes an outer liner connecting flange 96 that extends in a longitudinal direction L with respect to the combustor centerline axis 12'. The cowl structure 60 includes an outer cowl connecting flange 100 that extends in the longitudinal direction L. The cowl structure 60 includes a single outer cowl connecting flange 100, rather than including a clevis-type of flange having two flanges separated by a gap for connecting the cowl structure 60 to the CMC outer liner 54 and to the CMC dome structure 56. The CMC dome structure 56 includes the outer dome connecting flange 102 that extends in the longitudinal direction L. The outer connection 92 connects the outer liner connecting flange 96, the outer cowl connecting flange 100, and the outer dome connecting flange 102.

The outer connection 92 may be an outer bolted joint 104 that includes an outer liner bushing 106 that extends through an outer liner bushing opening 108 through the outer liner connecting flange 96, an outer dome bushing 110 that extends through an outer dome bushing opening 112 through the outer dome connecting flange 102, an outer cowl connecting flange opening 135 through the outer cowl connecting flange 100, and an outer fastener 114 that extends through the outer liner bushing 106, through the outer cowl connecting flange opening 135, and through the outer dome bushing 110. The outer liner bushing opening 108 may be slightly greater in diameter than an outer diameter of the outer liner bushing 106 so as to allow some radial movement of the CMC outer liner 54. Similarly, the outer dome bushing opening 112 may be slightly greater in diameter than an outer diameter of the outer dome bushing 110 so as to allow some radial movement of the CMC dome structure 56. The outer fastener 114 may be, for example, a bolt 116 and a nut 118. An outer side 120 of the outer liner bushing 106 is in contact with a bolt head 115 on a first end 122 of the outer fastener 114 (e.g., in contact with the bolt head 115 of the bolt 116), and an inner side 124 of the outer liner bushing 106 is in contact with an outer side 126 of the outer cowl connecting flange 100. An outer side 128 of the outer dome bushing 110 is in contact with an inner side 130 of the outer cowl connecting flange 100, and an inner side 132 of the outer dome bushing 110 is in contact with the nut 118 connected to a second end 134 of the outer fastener 114.

An outer seal cavity 136 is defined between the outer liner connecting flange 96 and the outer dome connecting flange 102, and an outer seal member 138 is arranged within the outer seal cavity 136 to seal an outer gap 140 between the outer liner connecting flange 96 and the outer dome connecting flange 102. A portion of the compressed air 85 flowing from the plenum 84 into the outer flow passage 88 can flow into a gap 127 between the outer liner connecting flange 96 and the outer cowl connecting flange 100 and then into the outer seal cavity 136, and a portion of the compressed air 83 within the pressure plenum 66 can flow into a gap 129 between the outer cowl connecting flange 100 and the outer dome connecting flange 102 into the outer seal cavity 136. The outer seal member 138 seals the outer gap 140 so that the compressed air 85 and the compressed air 83 within the outer seal cavity 136 is restricted from flowing therethrough into the combustion chamber 62. Here, the term "seals the outer gap" by the outer seal member 138 means to either prevent the compressed air 83 and the compressed air 85 from flowing through the outer gap 140, or to substantially limit (i.e., restrict) the amount of the compressed air 83 and the compressed air 85 that is permitted to flow through the outer gap 140 into the combustion chamber 62. As a result, additional compressed air 85 is available to flow within the outer flow passage 88 for other purposes, such as for the compressed air 85(*a*) to flow through the dilution openings 68 (FIG. 2). Further, additional compressed air 83 is available within the pressure plenum 66 to flow through the swirler assemblies 58 (FIG. 2).

Figure 4A:
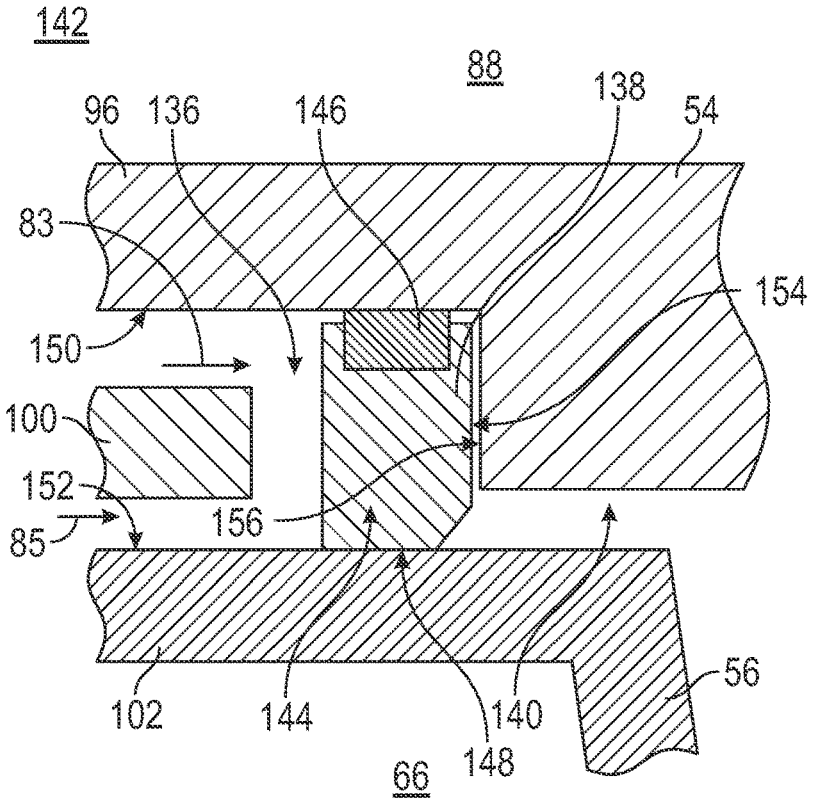
FIG. 4A is an enlarged partial cross-sectional side view of an outer seal cavity and an outer seal member, taken at detail view 142 of FIG. 3, according to an aspect of the present disclosure.

FIG. 4A is an enlarged partial cross-sectional side view of the outer seal cavity 136 and the outer seal member 138, taken at detail view 142 of FIG. 3, according to an aspect of the present disclosure. In FIG. 4A, the outer seal member 138 is shown to be a piston seal 144. A backer spring 146 of the piston seal 144 may be in contact with an inner side 150 of the outer liner connecting flange 96, and an inner side 148 of the piston seal 144 is in contact with an outer side 152 of the outer dome connecting flange 102. In addition, a downstream side 154 of the piston seal 144 may be, but need not be, in contact with a downstream end 156 of the outer seal cavity 136. As will be described below, the piston seal 144 extends circumferentially about the combustor centerline axis 12' (FIG. 3). Thus, the piston seal 144 can seal the outer gap 140.

Figure 4B:
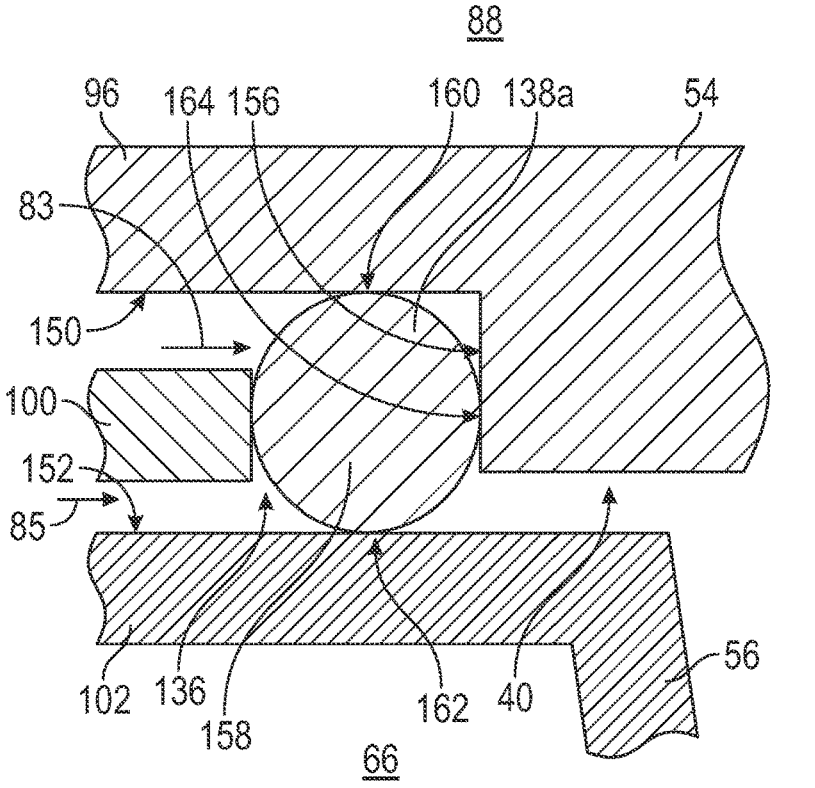
FIG. 4B depicts an alternate arrangement to that of FIG. 4A with an alternate outer seal member, according to an aspect of the present disclosure.

FIG. 4B depicts an alternate arrangement to that of FIG. 4A with an alternate outer seal member 138*a*, according to an aspect of the present disclosure. Elements that are the same in FIG. 4B to those in FIG. 4A are labeled with the same reference numerals. In FIG. 4B, the alternate outer seal member 138*a*, that is a rope seal 158, is included within the outer seal cavity 136. An outer side 160 of the rope seal 158 is in contact with the inner side 150 of the outer liner connecting flange 96, and an inner side 162 of the rope seal 158 is in contact with the outer side 152 of the outer dome connecting flange 102. In addition, a downstream side 164 of the rope seal 158 may be, but need not be, in contact with the downstream end 156 of the outer seal cavity 136. As will be described below, the rope seal 158 extends circumferentially about the combustor centerline axis 12' (FIG. 3). Thus, similar to the piston seal 144 (FIG. 4A), the rope seal 158 can seal the outer gap 140.

Figure 4C:
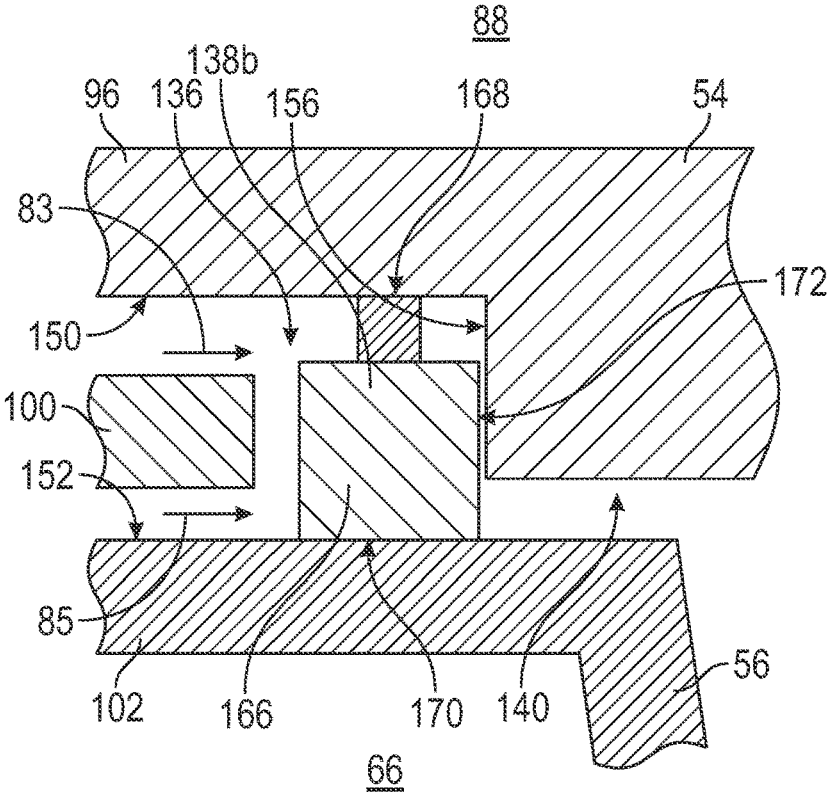
FIG. 4C depicts another alternate arrangement to that of FIG. 4A with an alternate outer seal member, according to an aspect of the present disclosure.

FIG. 4C depicts another alternate arrangement to that of FIG. 4A with an alternate outer seal member 138*b*, according to an aspect of the present disclosure. Elements that are the same in FIG. 4C to those in FIG. 4A are labeled with the same reference numerals. In FIG. 4C, the alternate outer seal member 138*b*, that is a brush seal 166, is included within the outer seal cavity 136. An outer side 168 of the brush seal 166 is in contact with the inner side 150 of the outer liner connecting flange 96, and an inner side 170 of the brush seal 166 is in contact with the outer side 152 of the outer dome connecting flange 102. In addition, a downstream side 172 of the brush seal 166 may be, but need not be, in contact with the downstream end 156 of the outer seal cavity 136. As will be described below, the brush seal 166 extends circumferentially about the combustor centerline axis 12' (FIG. 3). Thus, similar to the piston seal 144 (FIG. 4A), the brush seal 166 can seal the outer gap 140.

Figure 4D:
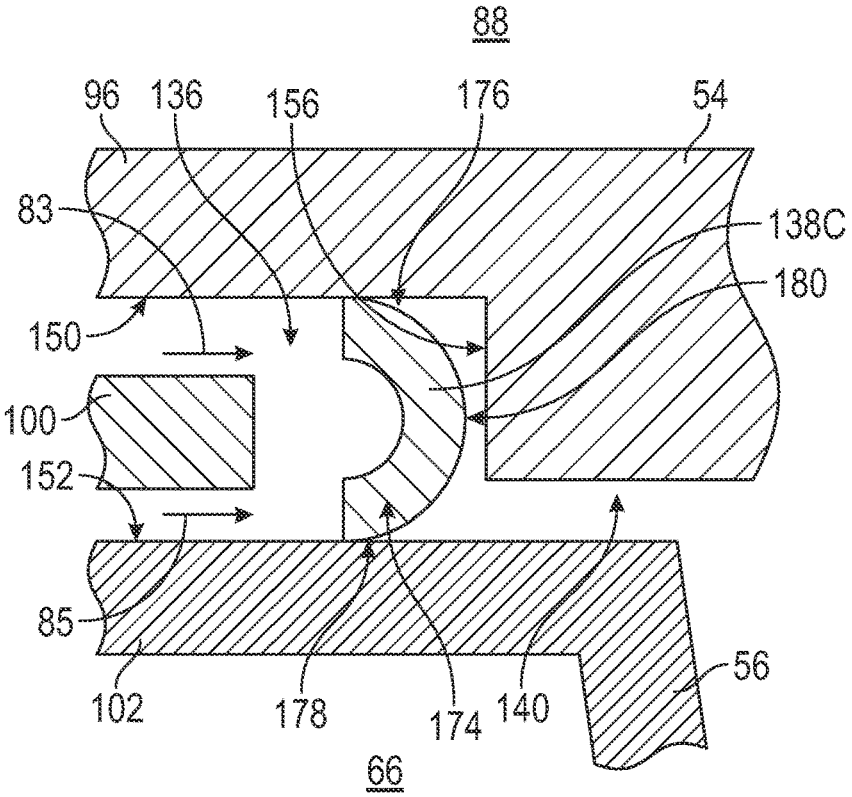
FIG. 4D depicts another alternate arrangement to that of FIG. 4A with an alternate outer seal member, according to an aspect of the present disclosure.

FIG. 4D depicts another alternate arrangement to that of FIG. 4A with an alternate outer seal member 138*c*, according to an aspect of the present disclosure. Elements that are the same in FIG. 4D to those in FIG. 4A are labeled with the same reference numerals. In FIG. 4D, the alternate outer seal member 138*c*, that is a C-seal 174, is included within the outer seal cavity 136. The C-seal 174 may be a metallic C-seal. An outer side 176 of the C-seal 174 is in contact with the inner side 150 of the outer liner connecting flange 96, and an inner side 178 of the C-seal 174 is in contact with the outer side 152 of the outer dome connecting flange 102. In addition, a downstream side 180 of the C-seal 174 may be, but need not be, in contact with the downstream end 156 of the outer seal cavity 136. As will be described below, the C-seal 174 extends circumferentially about the combustor centerline axis 12' (FIG. 3). Thus, similar to the piston seal 144 (FIG. 4A), the C-seal 174 can seal the outer gap 140.

Figure 4E:
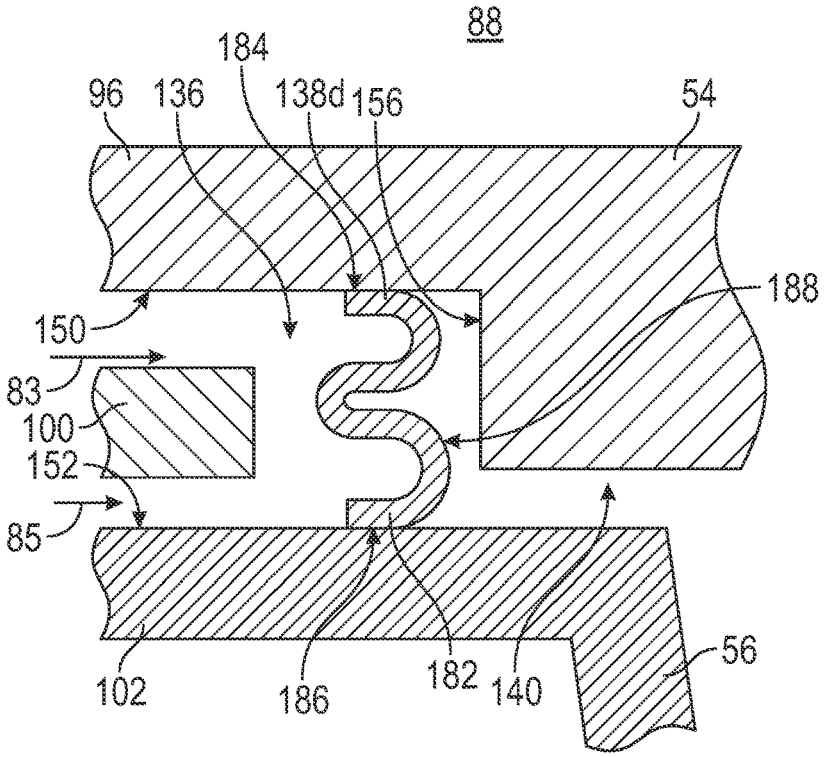
FIG. 4E depicts another alternate arrangement to that of FIG. 4A with an alternate outer seal member, according to an aspect of the present disclosure.

FIG. 4E depicts another alternate arrangement to that of FIG. 4A with an alternate outer seal member 138*d*, according to an aspect of the present disclosure. Elements that are the same in FIG. 4E to those in FIG. 4A are labeled with the same reference numerals. In FIG. 4E, the alternate outer seal member 138*d*, that is a W-seal 182, is included within the outer seal cavity 136. The W-seal 182 may be a metallic W-seal. An outer side 184 of the W-seal 182 is in contact with the inner side 150 of the outer liner connecting flange 96, and an inner side 186 of the W-seal 182 is in contact with the outer side 152 of the outer dome connecting flange 102. In addition, a downstream side 188 of the W-seal 182 may be, but need not be, in contact with the downstream end 156 of the outer seal cavity 136. As will be described below, the W-seal 182 extends circumferentially about the combustor centerline axis 12' (FIG. 3). Thus, similar to the piston seal 144 (FIG. 4A), the metallic W-seal 182 can seal the outer gap 140.

Figure 4F:
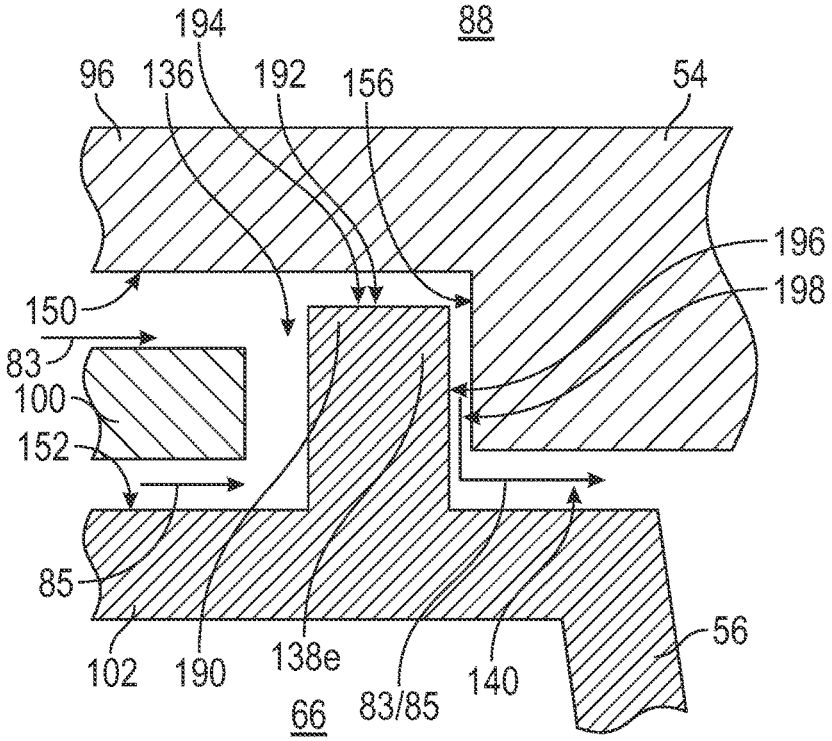
FIG. 4F depicts another alternate arrangement to that of FIG. 4A with an alternate outer seal member, according to an aspect of the present disclosure.

FIG. 4F depicts another alternate arrangement to that of FIG. 4A with an alternate outer seal member 138*e*, according to an aspect of the present disclosure. Elements that are the same in FIG. 4F to those in FIG. 4A are labeled with the same reference numerals. In FIG. 4F, the alternate outer seal member 138*e* is a discourager 190 that is apart of the outer dome connecting flange 102 (i.e., may be formed integral with the outer dome connecting flange 102 as shown in FIG. 4F) and extends radially outward from the outer side 152 of the outer dome connecting flange 102 into the outer seal cavity 136. Alternatively, the discourager 190 may be a separate component part that is connected to (e.g., brazed to) the outer dome connecting flange 102. An outer side 192 of the discourager 190 is arranged to provide a gap 194 between the outer side 192 of the discourager 190 and the inner side 150 of the outer liner connecting flange 96. In addition, a downstream side 196 of the discourager 190 is arranged to provide a gap 198 between the downstream side 196 of the discourager 190 and the downstream end 156 of the outer seal cavity 136. As will be described below, the discourager 190 extends circumferentially about the combustor centerline axis 12' (FIG. 3). Thus, the discourager 190 is arranged to seal the outer gap 140 by restricting the amount of the compressed air 83 and the compressed air 85 that can purge out of the outer seal cavity 136 through the gap 194 and through the gap 198 into the outer gap 140 by limiting the amount of the compressed air 83 and the compressed air 85 that is permitted to flow into the outer gap 140.

Figure 4G:
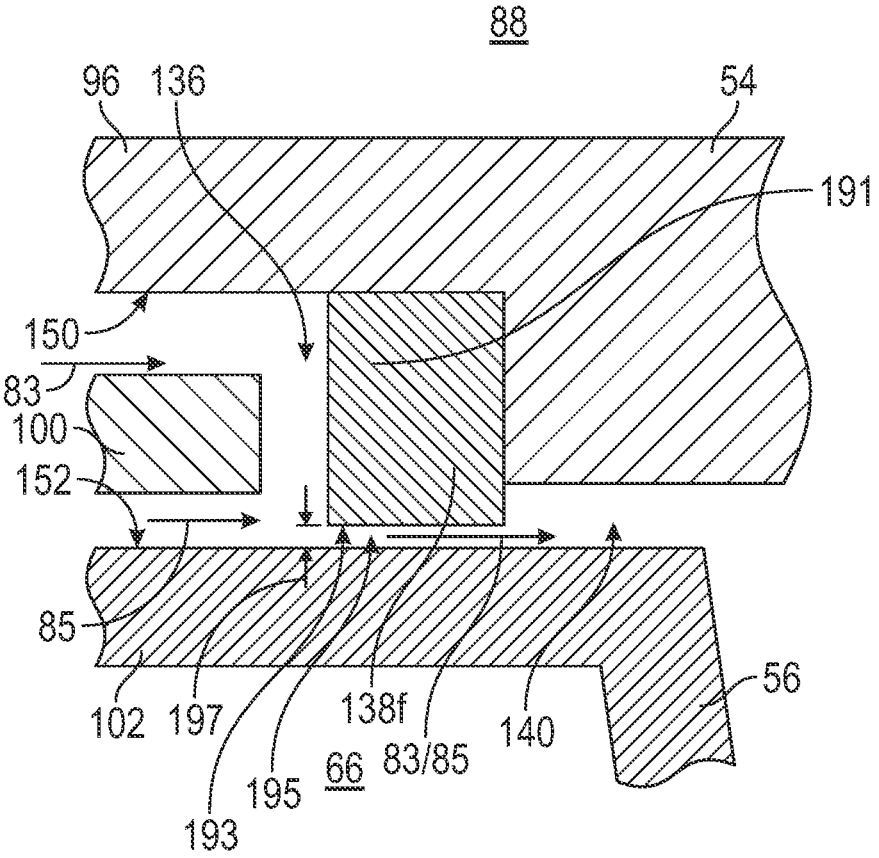
FIG. 4G depicts another alternate arrangement to that of FIG. 4A with an alternate outer seal member, according to an aspect of the present disclosure.

FIG. 4G depicts another alternate arrangement to that of FIG. 4A with an alternate outer seal member 138*f*, according to an aspect of the present disclosure. As an alternative to the discourager 190 of FIG. 4F, rather than the discourager 190 being part the outer dome connecting flange 102 (i.e., being formed integral with the outer dome connecting flange 102) and extending radially outward into the outer seal cavity 136, a discourager 191 may instead be a part of (i.e., integral with) the outer liner connecting flange 96, or may be a separate component that is connected to (e.g., brazed to) the outer liner connecting flange 96, and extends radially inward from the inner side 150 of the outer liner connecting flange 96 into the outer seal cavity 136. An inner side 193 of the discourager 191 is arranged to provide a gap 195 between the inner side 193 of the discourager 191 and the outer side 152 of the outer dome connecting flange 102. A radial height 197 of the gap 195 is arranged so as to restrict (i.e., limit) an amount of the compressed air 83 and the compressed air 85 that is permitted to pass through the gap 195 into the outer gap 140 so as to provide a sealing function to the outer seal cavity 136.

FIG. 4A to FIG. 4G depict various examples of seals that may be implemented within the outer seal cavity 136. However, the present disclosure is not limited to the seals depicted in FIG. 4A to FIG. 4G and other types of seals may be implemented instead.

Figure 5:
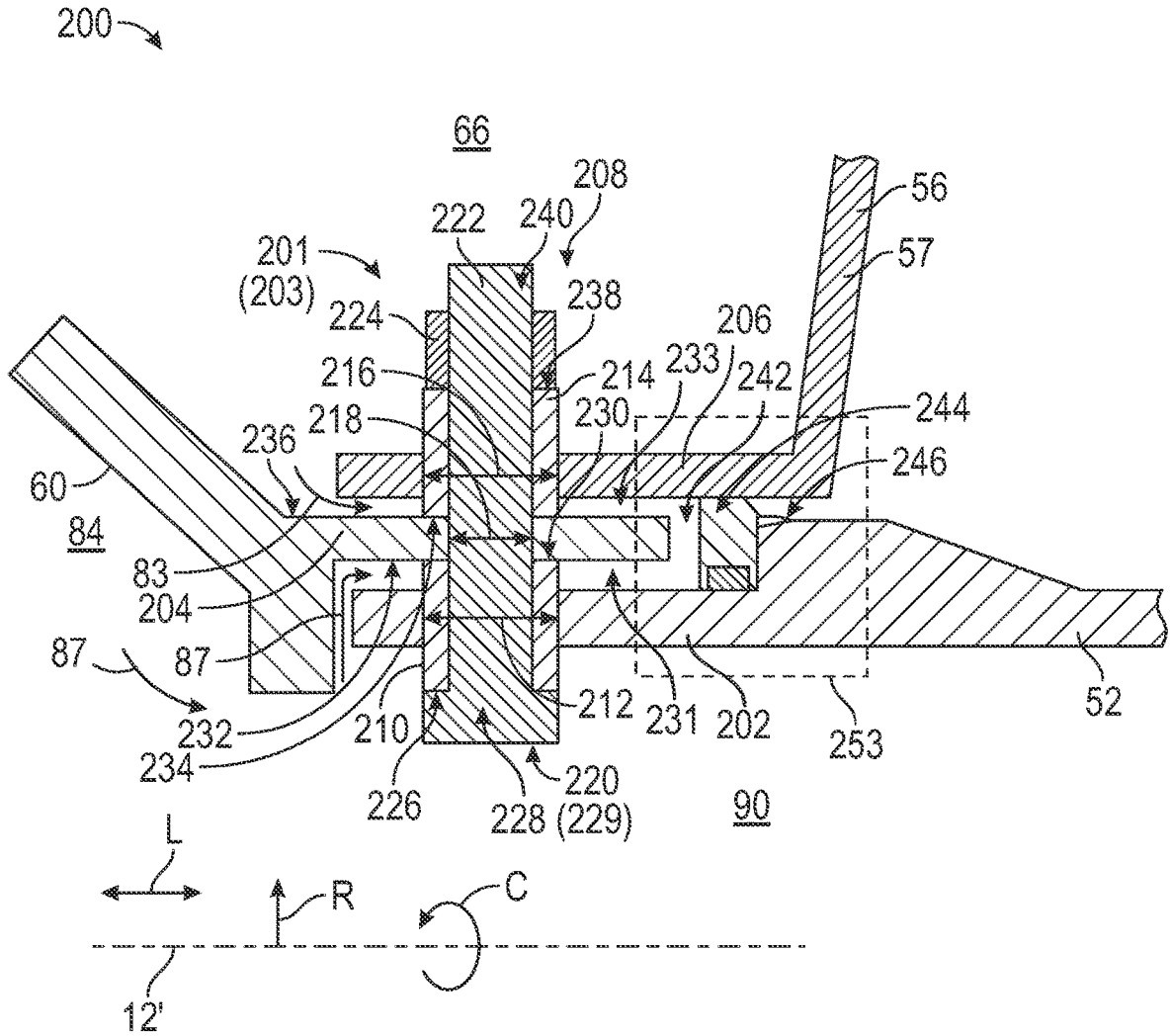
FIG. 5 is an enlarged partial cross-sectional side view of an inner connection, taken at detail view 200 of FIG. 2, according to an aspect of the present disclosure.

FIG. 5 is an enlarged partial cross-sectional side view of an inner connection 201, taken at detail view 200 of FIG. 2, according to an aspect of the present disclosure. As will be explained in more detail below, the inner connection 201 is an inner bolted joint 203. In FIG. 5, the CMC inner liner 52 includes an inner liner connecting flange 202 that extends in the longitudinal direction L with respect to the combustor centerline axis 12'. The cowl structure 60 includes an inner cowl connecting flange 204 that extends in the longitudinal direction L. The cowl structure 60 includes a single inner cowl connecting flange 204, rather than including a clevis-type flange having two flanges separated by a gap for connecting the cowl structure 60 to the CMC inner liner 52 and to the CMC dome structure 56. The CMC dome structure 56 includes an inner dome connecting flange 206 that extends in the longitudinal direction L. The inner connection 201, which will now be described in more detail, connects the inner liner connecting flange 202, the inner cowl connecting flange 204, and the inner dome connecting flange 206.

The inner connection 201 may be an inner bolted joint 208 that includes an inner liner bushing 210 that extends through an inner liner bushing opening 212 through the inner liner connecting flange 202, an inner dome bushing 214 that extends through an inner dome bushing opening 216 through the inner dome connecting flange 206, an inner cowl connecting flange opening 218 through the inner cowl connecting flange 204, and an inner fastener 220 that extends through the inner liner bushing 210, through the inner cowl connecting flange opening 218, and through the inner dome bushing 214. The inner liner bushing opening 212 may be slightly greater in diameter than an outer diameter of the inner liner bushing 210 so as to allow some radial movement of the CMC inner liner 52. Similarly, the inner dome bushing opening 216 may be slightly greater in diameter than an outer diameter of the inner dome bushing 214 so as to allow some radial movement of the CMC dome structure 56. The inner fastener 220 may be, for example, a bolt 222 and a nut 224. An inner side 226 of the inner liner bushing 210 is in contact with a bolt head 229 on a first end 228 of the inner fastener 220 (e.g., in contact with the bolt head 229 of the bolt 222), and an outer side 230 of the inner liner bushing 210 is in contact with an inner side 232 of the inner cowl connecting flange 204. An inner side 234 of the inner dome bushing 214 is in contact with an outer side 236 of the inner cowl connecting flange 204, and an outer side 238 of the inner dome bushing 214 is in contact with the nut 224 connected to a second end 240 of the inner fastener 220.

An inner seal cavity 242 is defined between the inner liner connecting flange 202 and the inner dome connecting flange 206, and an inner seal member 244 is arranged within the inner seal cavity 242 to seal an inner gap 246 between the inner liner connecting flange 202 and the inner dome connecting flange 206. A portion of the compressed air 87 flowing from the plenum 84 into the inner flow passage 90 can flow into a gap 231 between the inner liner connecting flange 202 and the inner cowl connecting flange 204 and then into the inner seal cavity 242, and a portion of the compressed air 83 within the pressure plenum 66 can flow into a gap 233 between the inner cowl connecting flange 204 and the inner dome connecting flange 206 into the inner seal cavity 242. The inner seal member 244 seals the inner gap 246 so that the compressed air 87 and the compressed air 83 within the inner seal cavity 242 is restricted from flowing therethrough into the combustion chamber 62. That is, the inner seal member 244 either prevents the compressed air 83 and the compressed air 87 from flowing through the inner gap 246, or substantially limits the amount of the compressed air 83 and the compressed air 87 that is permitted to flow through the inner gap 246 into the combustion chamber 62. As a result, additional compressed air 87 is available to flow within the inner flow passage 90 for other purposes, such as for the compressed air 87(*a*) to flow through the dilution openings 69. Further, additional compressed air 83 is available within the pressure plenum 66 to flow through the swirler assemblies 58.

Figure 6A:
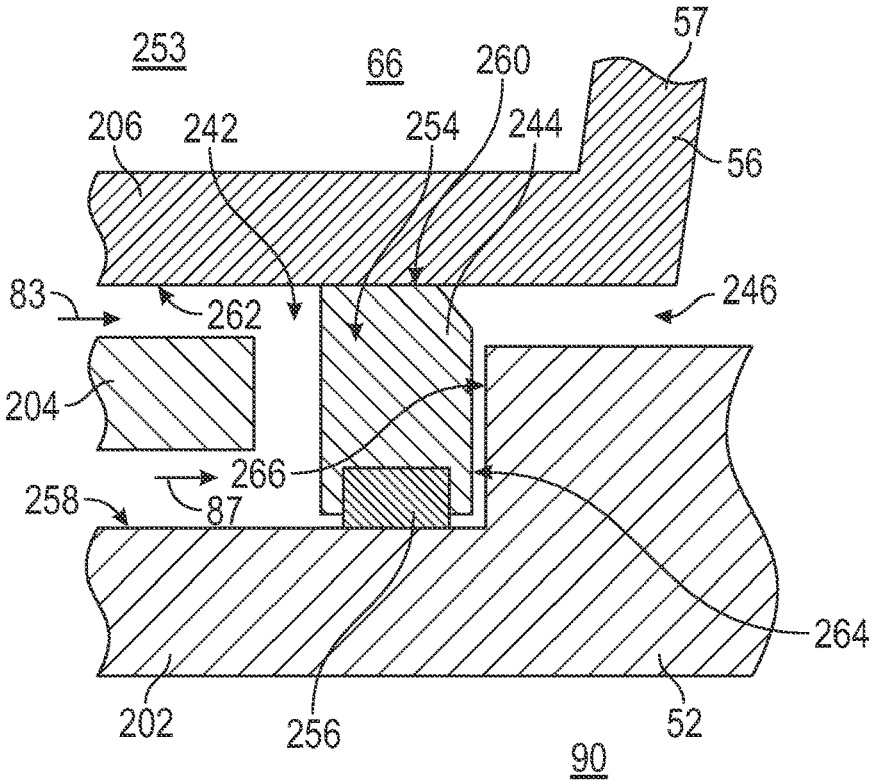
FIG. 6A is an enlarged partial cross-sectional side view of an inner seal cavity and an inner seal member, taken at detail view 253 of FIG. 5, according to an aspect of the present disclosure.

FIG. 6A is an enlarged partial cross-sectional side view of the inner seal cavity 242 and the inner seal member 244, taken at detail view 253 of FIG. 5, according to an aspect of the present disclosure. In FIG. 6A, the inner seal member 244 is shown to be a piston seal 254. A backer spring 256 of the piston seal 254 may be in contact with an outer side 258 of the inner liner connecting flange 202, and an outer side 260 of the piston seal 254 is in contact with an inner side 262 of the inner dome connecting flange 206. In addition, a downstream side 264 of the piston seal 254 may be, but need not be, in contact with a downstream end 266 of the inner seal cavity 242. As with the piston seal 144 (FIG. 4A), the piston seal 254 extends circumferentially about the combustor centerline axis 12' (FIG. 5). Thus, the piston seal 254 can seal the inner gap 246.

Figure 6B:
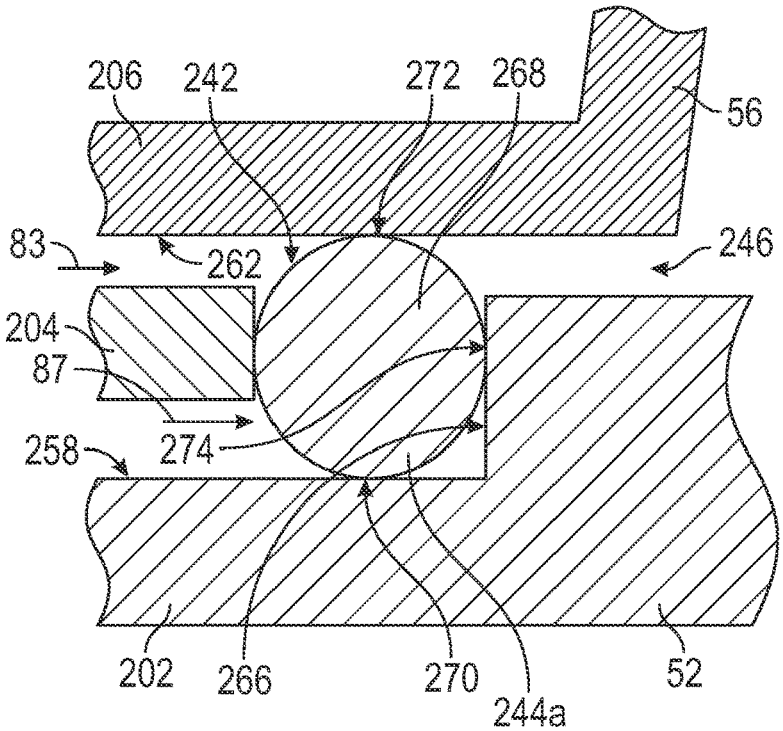
FIG. 6B depicts an alternate arrangement to that of FIG. 6A with an alternate inner seal member, according to an aspect of the present disclosure.

FIG. 6B depicts an alternate arrangement to that of FIG. 6A with an alternate inner seal member 244*a*, according to an aspect of the present disclosure. Elements that are the same in FIG. 6B to those in FIG. 6A are labeled with the same reference numerals. In FIG. 6B, the alternate inner seal member 244*a*, that is a rope seal 268, is included within the inner seal cavity 242. An inner side 270 of the rope seal 268 is in contact with the outer side 258 of the inner liner connecting flange 202, and an outer side 272 of the rope seal 268 is in contact with the inner side 262 of the inner dome connecting flange 206. In addition, a downstream side 274 of the rope seal 268 may be, but need not be, in contact with the downstream end 266 of the inner seal cavity 242. The rope seal 268 extends circumferentially about the combustor centerline axis 12' (FIG. 5). Thus, similar to the piston seal 254 (FIG. 6A), the rope seal 268 can seal the inner gap 246.

Figure 6C:
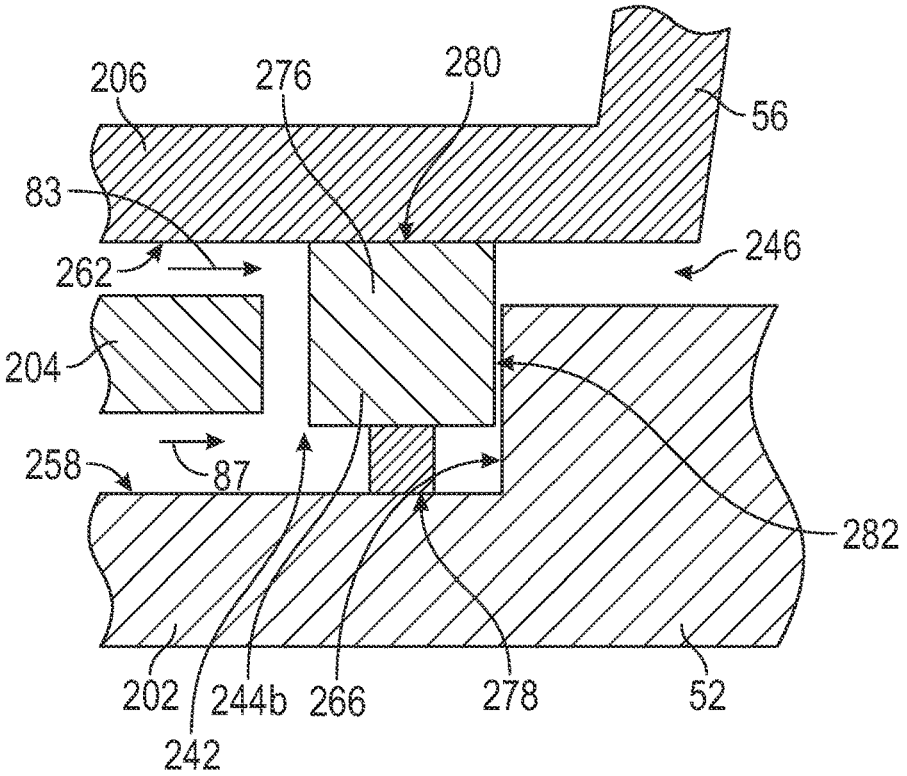
FIG. 6C depicts another alternate arrangement to that of FIG. 6A with an alternate inner seal member, according to an aspect of the present disclosure.

FIG. 6C depicts another alternate arrangement to that of FIG. 6A with an alternate inner seal member 244*b*, according to an aspect of the present disclosure. Elements that are the same in FIG. 6C to those in FIG. 6A are labeled with the same reference numerals. In FIG. 6C, the alternate inner seal member 244*b*, that is a brush seal 276, is included within the inner seal cavity 242. An inner side 278 of the brush seal 276 is in contact with the outer side 258 of the inner liner connecting flange 202, and an outer side 280 of the brush seal 276 is in contact with the inner side 262 of the inner dome connecting flange 206. In addition, a downstream side 288 of the brush seal 276 may be, but need not be, in contact with the downstream end 266 of the inner seal cavity 242. The brush seal 276 extends circumferentially about the combustor centerline axis 12' (FIG. 5). Thus, similar to the piston seal 254 (FIG. 6A), the brush seal 276 can seal the inner gap 246.

Figure 6D:
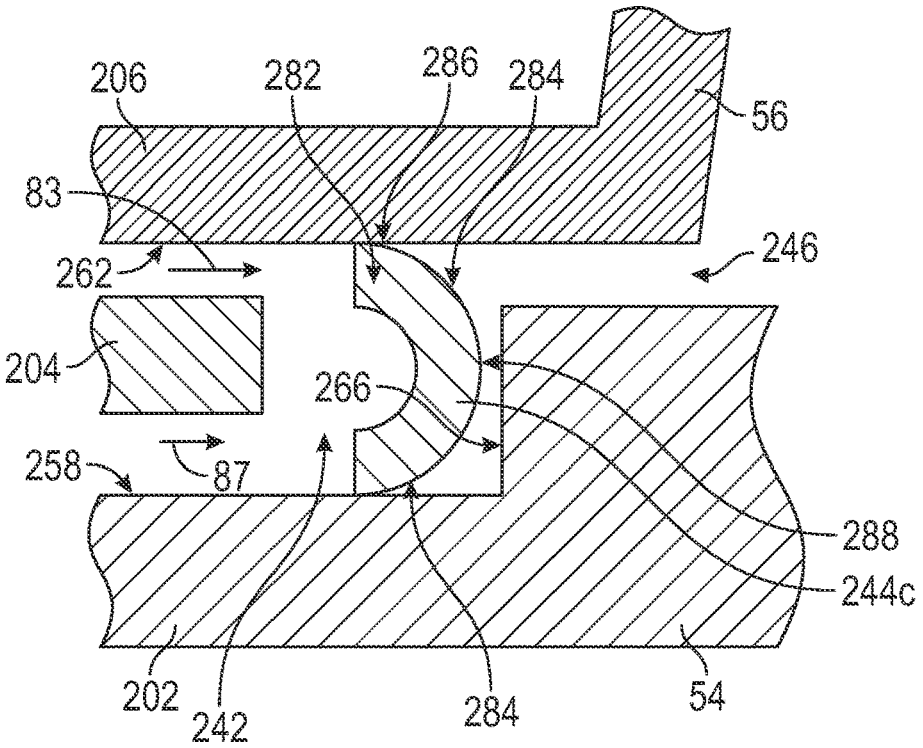
FIG. 6D depicts another alternate arrangement to that of FIG. 6A with an alternate inner seal member, according to an aspect of the present disclosure.

FIG. 6D depicts another alternate arrangement to that of FIG. 6A with an alternate inner seal member 244*c*, according to an aspect of the present disclosure. Elements that are the same in FIG. 6D to those in FIG. 6A are labeled with the same reference numerals. In FIG. 6D, the alternate inner seal member 244*c*, that is a C-seal 282, is included within the inner seal cavity 242. The C-seal 282 may be a metallic C-seal. An inner side 284 of the C-seal 282 is in contact with the outer side 258 of the inner liner connecting flange 202, and an outer side 286 of the C-seal 282 is in contact with the inner side 262 of the inner dome connecting flange 206. In addition, the downstream side 288 of the C-seal 282 may be, but need not be, in contact with the downstream end 266 of the inner seal cavity 242. The C-seal 282 extends circumferentially about the combustor centerline axis 12' (FIG. 5). Thus, similar to the piston seal 254 (FIG. 6A), the C-seal 282 can seal the inner gap 246.

Figure 6E:
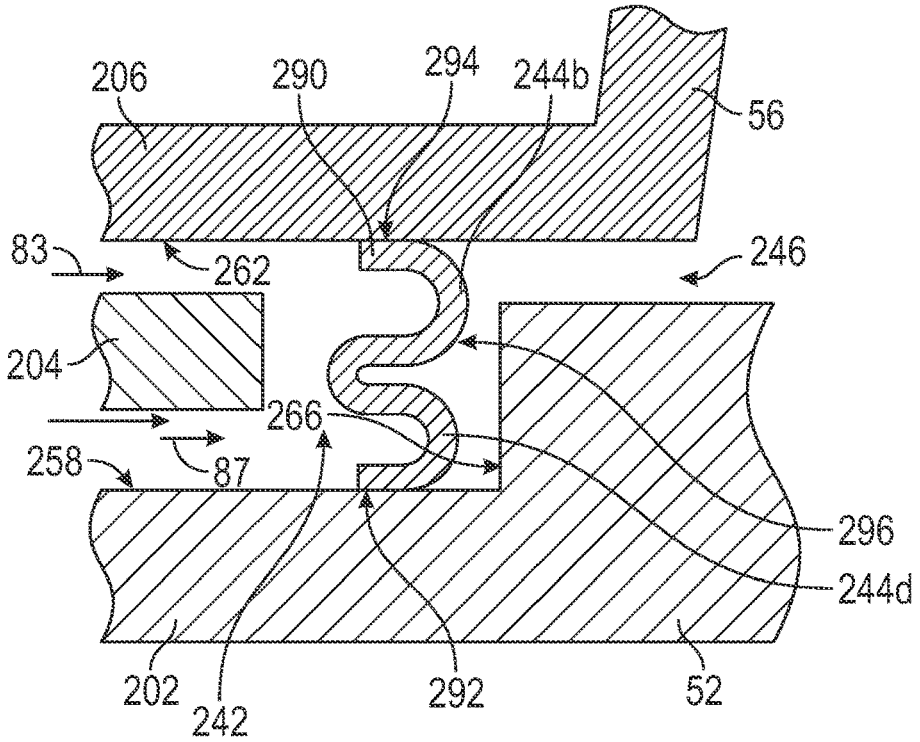
FIG. 6E depicts another alternate arrangement to that of FIG. 6A with an alternate inner seal member, according to an aspect of the present disclosure.

FIG. 6E depicts another alternate arrangement to that of FIG. 6A with an alternate inner seal member 244*d*, according to an aspect of the present disclosure. Elements that are the same in FIG. 6E to those in FIG. 6A are labeled with the same reference numerals. In FIG. 6E, the alternate inner seal member 244*d*, that is a W-seal 290, is included within the inner seal cavity 242. The W-seal 290 may be a metallic W-seal. An inner side 292 of the W-seal 290 is in contact with the outer side 258 of the inner liner connecting flange 202, and an outer side 294 of the W-seal 290 is in contact with the inner side 262 of the inner dome connecting flange 206. In addition, a downstream side 296 of the W-seal 290 may be, but need not be, in contact with the downstream end 266 of the inner seal cavity 242. The W-seal 290 extends circumferentially about the combustor centerline axis 12' (FIG. 5). Thus, similar to the piston seal 254 (FIG. 6A), the W-seal 290 can seal the inner gap 246.

Figure 6F:
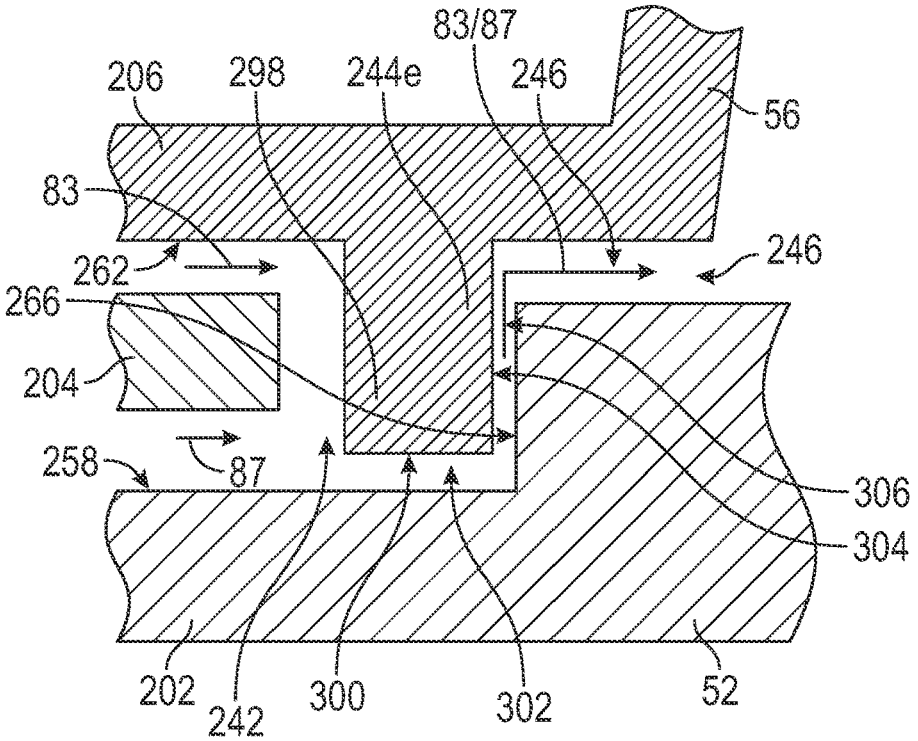
FIG. 6F depicts another alternate arrangement to that of FIG. 6A with an alternate inner seal member, according to an aspect of the present disclosure.

FIG. 6F depicts another alternate arrangement to that of FIG. 6A with an alternate inner seal member 244*e*, according to an aspect of the present disclosure. Elements that are the same in FIG. 6F to those in FIG. 6A are labeled with the same reference numerals. In FIG. 6F, the alternate inner seal member 244*e* is a discourager 298 that is a part of (i.e., may be formed integral with the inner dome connecting flange 206 as shown in FIG. 6F) the inner dome connecting flange 206 and extends radially inward from the inner side 262 of the inner dome connecting flange 206 into the inner seal cavity 242. Alternatively, the discourager 298 may be a separate component part that is connected to (e.g., brazed to) the inner dome connecting flange 206. An inner side 300 of the discourager 298 is arranged to provide a gap 302 between the inner side 300 of the discourager 298 and the outer side 258 of the inner liner connecting flange 202. In addition, a downstream side 304 of the discourager 298 is arranged to provide a gap 306 between the downstream side 304 of the discourager 298 and the downstream end 266 of the inner seal cavity 242. The discourager 298 extends circumferentially about the combustor centerline axis 12' (FIG. 5). Thus, the discourager 298 is arranged to seal the inner gap 246 by restricting the amount of the compressed air 83 and the compressed air 87 that can purge out of the inner seal cavity 242 through the gap 302 and through the gap 306 into the inner gap 246 by limiting the amount of the compressed air 83 and the compressed air 87 that is permitted to flow into the inner gap 246.

Figure 6G:
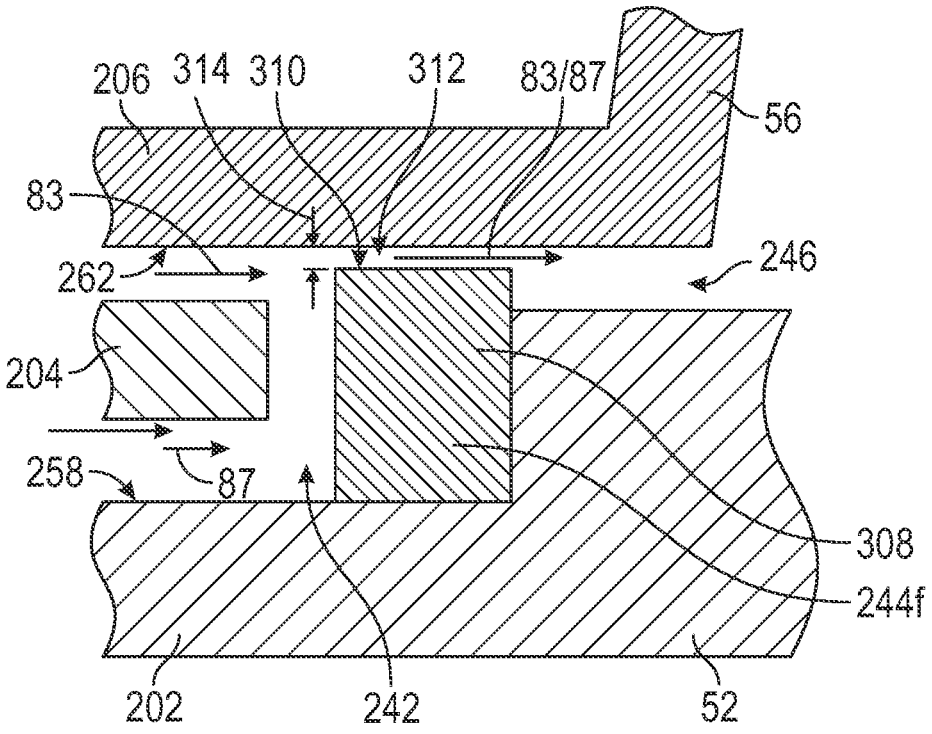
FIG. 6G depicts another alternate arrangement to that of FIG. 6A with an alternate inner seal member, according to an aspect of the present disclosure.

FIG. 6G depicts another alternate arrangement to that of FIG. 6A with an alternate inner seal member 244*f*, according to an aspect of the present disclosure. As an alternative to the discourager 298 of FIG. 6F, rather than the discourager 298 being part of the inner dome connecting flange 206 (i.e., being formed integral with the inner dome connecting flange 206) and extending radially inward into the inner seal cavity 242, a discourager 308 may instead be part of (i.e., integral with) the inner liner connecting flange 202, or may be a separate component that is connected to (e.g., brazed to) the inner liner connecting flange 202 and extends radially outward from the outer side 258 of the inner liner connecting flange 202 into the inner seal cavity 242. An outer side 310 of the discourager 308 is arranged to provide a gap 312 between the outer side 310 of the discourager 308 and the inner side 262 of the inner dome connecting flange 206. A radial height 314 of the gap 312 is arranged so as to restrict (i.e., limit) an amount of the compressed air 83 and the compressed air 87 that is permitted to pass through the gap 312 into the inner gap 246 so as to provide a sealing function to the inner seal cavity 242.

FIG. 6A to FIG. 6G depict various examples of seals that may be implemented within the inner seal cavity 242. However, the present disclosure is not limited to the seals depicted in FIG. 6A to FIG. 6G and other types of seals may be implemented instead.

Figure 7:
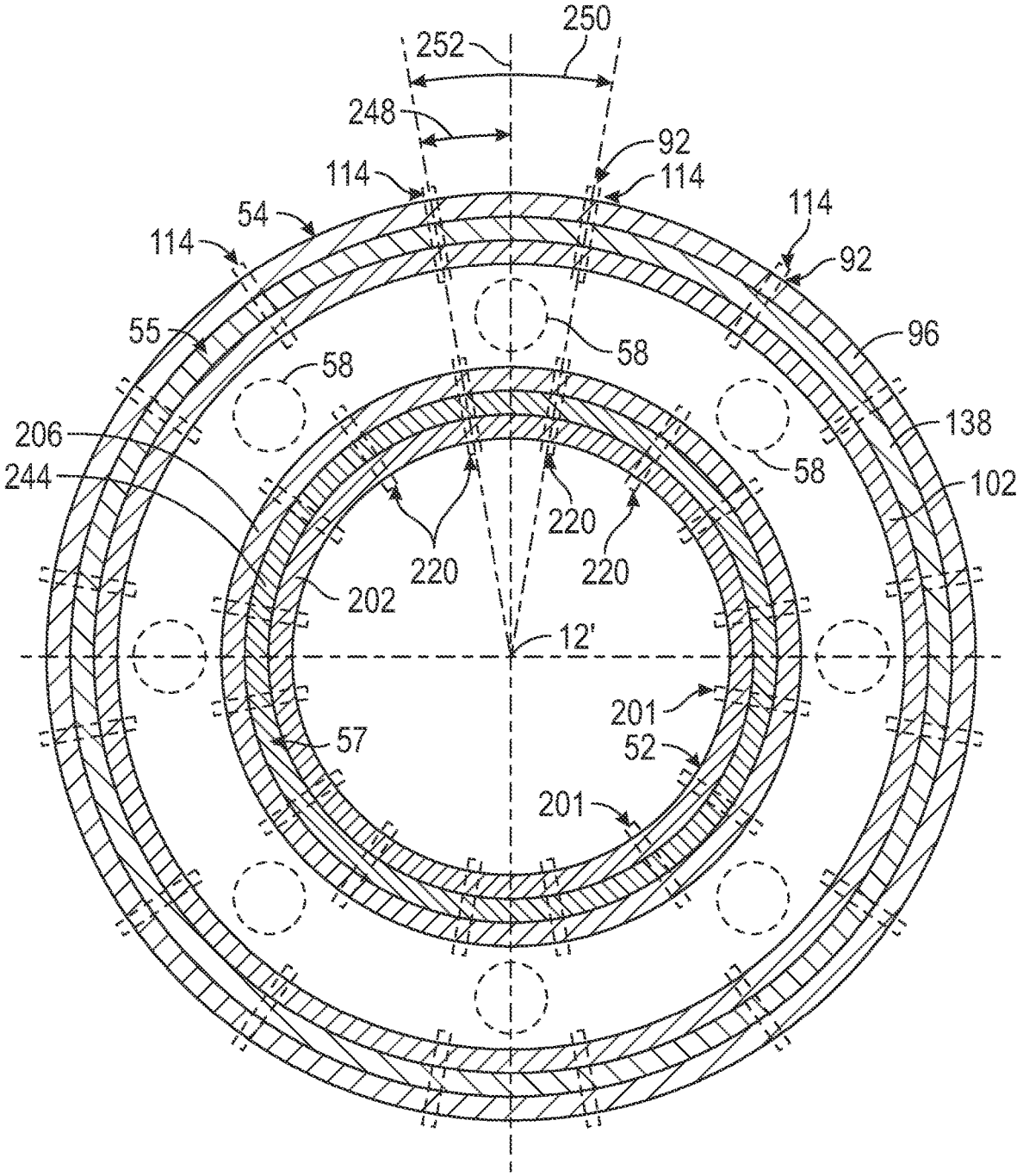
FIG. 7 is a cross-sectional forward-looking view of a portion of the combustor, taken at plane 7-7 of FIG. 2, according to an aspect of the present disclosure.

FIG. 7 is a cross-sectional forward-looking view of a portion of the combustion section 26, taken at plane 7-7 of FIG. 2, according to an aspect of the present disclosure. In FIG. 7, the plurality of swirler assemblies 58 are shown generally with dashed lines for reference. In addition, the plurality of outer fasteners 114 and the plurality of inner fasteners 220, which are located upstream of plane 7-7 in FIG. 2, are shown generally with dashed lines for reference. As was described above with regard to FIG. 2, the combustion section 26 is an annular-type combustor that extends circumferentially about the combustor centerline axis 12', and the combustion section 26 includes the CMC inner liner 52, the CMC outer liner 54, and the dome structure 56, each of which extends annularly about the combustor centerline axis 12'. As shown in FIG. 7, the outer liner connecting flange 96, which is part of the CMC outer liner 54, and the inner liner connecting flange 202, which is part of the CMC inner liner 52, also extend annularly about the combustor centerline axis 12'. Likewise, the outer dome connecting flange 102 and the inner dome connecting flange 206, which are part of the annular dome structure 56, extend annularly about the combustor centerline axis 12'. In addition, the outer seal member 138 and the inner seal member 244 extend annularly about the combustor centerline axis 12'. A plurality of outer connections 92 having the outer fasteners 114 are circumferentially spaced apart and may be offset by an angular amount 248 from a centerline 252 through the swirler assemblies 58, and may be circumferentially spaced apart from one another by an angular amount 250. Similarly, a plurality of inner connections 201 having the inner fasteners 220 are circumferentially spaced apart and may be offset by the angular amount 248 from the centerline 252 through the swirler assemblies 58, and may be circumferentially spaced apart from one another by the angular amount 250.

Figure 8:
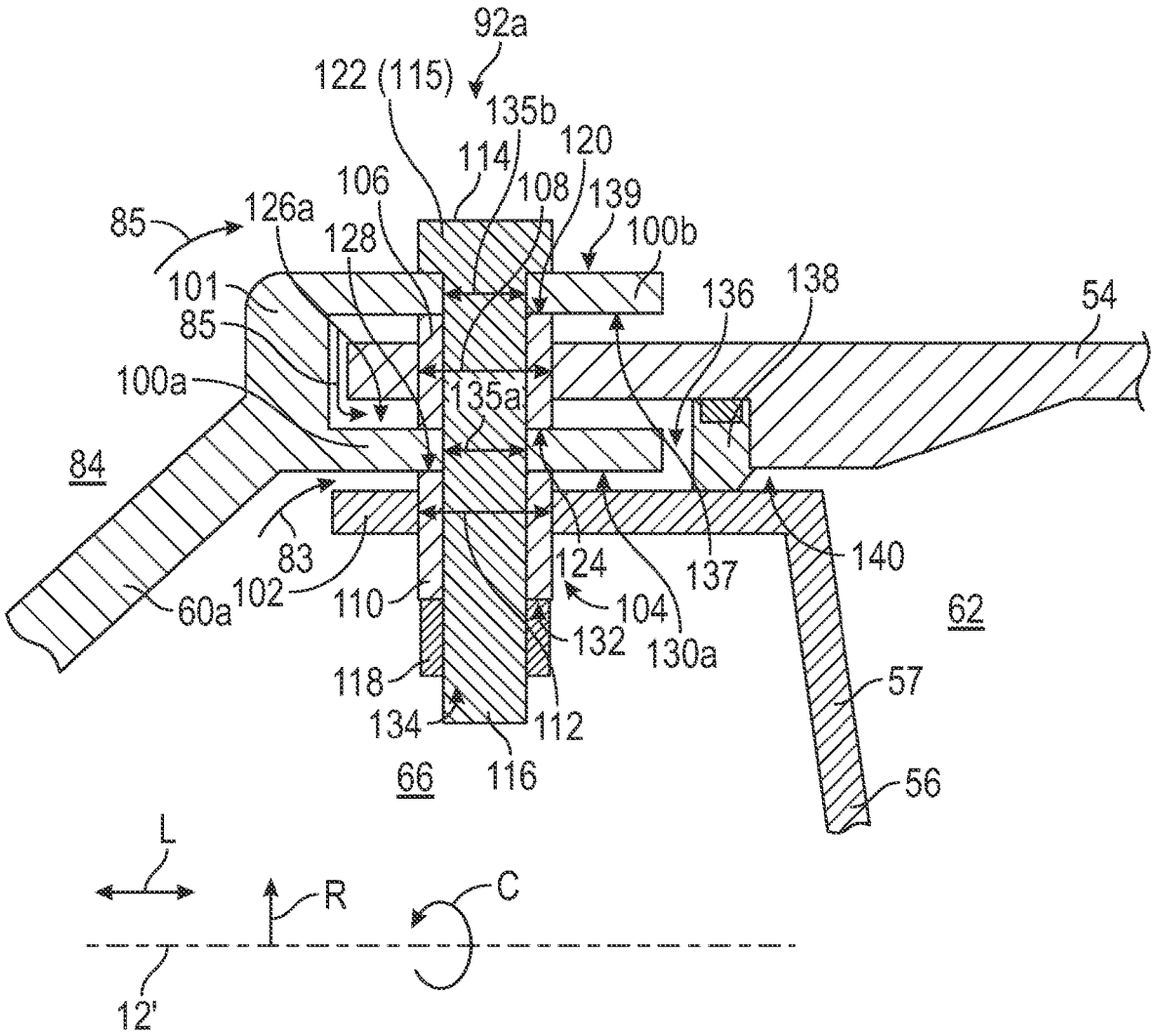
FIG. 8 depicts an alternate outer connection to the outer connection of FIG. 3, according to an aspect of the present disclosure.

FIG. 8 depicts an alternate outer connection 92*a* to the outer connection 92 of FIG. 3, according to an aspect of the present disclosure. In the FIG. 8 aspect, elements that are the same as those of the FIG. 3 aspect have the same reference numerals. In the FIG. 8 aspect, an alternate cowl structure 60*a* has an outer connecting clevis 101 that includes a first outer cowl connecting flange 100*a* and a second outer cowl connecting flange 100*b*. The first outer cowl connecting flange 100*a* is similar to the outer cowl connecting flange 100 of FIG. 3, and includes a first outer connecting flange opening 135*a* therethrough. The second outer cowl connecting flange 100*b* includes a second outer cowl connecting flange opening 135*b* therethrough. The outer liner bushing 106 is inserted within the outer connecting clevis 101 so that the inner side 124 of the outer liner bushing 106 contacts an outer side 126*a* of the first outer cowl connecting flange 100*a*, and the outer side 120 of the outer liner bushing 106 contacts an inner side 137 of the second outer cowl connecting flange 100*b*. The outer dome bushing 110 is inserted within the outer dome bushing opening 112 of the outer dome connecting flange 102, and the outer side 128 of the outer dome bushing 110 engages with an inner side 130*b* of the first outer cowl connecting flange 100*a*. In forming the outer connection 92*a*, the outer fastener 114 is inserted through the second outer cowl connecting flange opening 135*b*, through the outer liner bushing 106, through the first outer cowl connecting flange opening 135*a*, and through the outer dome bushing 110 so that that first end 122 of the outer fastener 114 (e.g., the bolt head 115 of the bolt 116) engages with an outer side 139 of the second outer cowl connecting flange 100*b*, and then the nut 118 is threadedly engaged with the bolt 116 and torqued to tighten the connection. The FIG. 8 aspect thus provides for including the outer seal member 138 within the outer seal cavity 136 in the same manner as described for the FIG. 3 aspect, and the present disclosure is therefore applicable to a double yoke (or clevis-type) of connection with the cowl structure 60*a*. Of course, a similar double yoke (or clevis-type) similar to the FIG. 8 aspect could be implemented for the inner connection 201.

Each of the foregoing aspects provide a technique to reduce airflow leakage through the connections between the outer liner, the inner liner, the cowl structure, and the dome by including a seal member within a seal cavity at the connection. In particular, in combustors that implement CMC liners and a CMC dome structure, while the cowl structure is metallic, the use of the CMC materials, which have a lower coefficient of thermal expansion than metallic materials, results in both lower absolute and relative radial motion between adjacent CMC components compared to that of a CMC component being adjacent to a metallic component. By implementing a seal within a cavity residing between interfacing CMC components, and by locating the cavity downstream of the connection features (e.g., a connecting bolt), the amount of leakage airflow through the connection can be better controlled to reduce the airflow leakage through the connections into the combustion chamber, thereby providing for additional air to be available within the combustor for other purposes.

In addition to the foregoing aspects described above, the seal aspects could be applied in numerous situations involving the sealing of a CMC component (or other material with a significant mismatch in thermal expansion coefficient relative to metallic materials) to an adjacent metallic, or a CMC component to another adjacent CMC component within a gas turbine engine and other applications within the aerospace and defense sectors. Within a gas turbine engine, for example, applications of the foregoing sealing approach could include turbine ring shrouds, exhaust nozzle and afterburner components, and interfaces between these adjacent hot-section engine modules. Additional propulsion related applications could include combustion components on ramjet/scramjet engines including liners, flame holders, and the connections between these various parts. The foregoing sealing aspects could also be utilized in rocket engine combustors and on hypersonic vehicles including attachment mechanisms of thermal protection systems. Additionally, the shape of the components being attached to one another doesn't require them to be axisymmetric or round in geometry; they can take on myriad shapes including flat panels, conical members, etc.

While the foregoing description relates generally to a gas turbine engine, the gas turbine engine may be implemented in various environments. For example, the engine may be implemented in an aircraft, but may also be implemented in non-aircraft applications, such as power generating stations, marine applications, or oil and gas production applications. Thus, the present disclosure is not limited to use in aircraft.

Further aspects of the present disclosure are provided by the subject matter of the following clauses.

A combustor for a gas turbine engine, the combustor receiving an airflow from a compressor section of the gas turbine engine, the airflow being provided to a combustion chamber within the combustor, the combustor including a ceramic matrix composite (CMC) dome structure including an outer dome connecting flange extending in a longitudinal direction, an inner dome connecting flange extending in the longitudinal direction, and dome plate extending between the outer dome connecting flange and the inner dome connecting flange, a CMC outer liner including an outer liner connecting flange extending in the longitudinal direction, a CMC inner liner including an inner liner connecting flange extending in the longitudinal direction, a cowl structure including an outer cowl connecting flange extending in the longitudinal direction and an inner cowl connecting flange extending in the longitudinal direction, at least one outer connection connecting the outer liner connecting flange, the outer cowl connecting flange, and the outer dome connecting flange, at least one inner connection connecting the inner liner connecting flange, the inner cowl connecting flange, and the inner dome connecting flange, an outer seal member arranged to seal an outer gap between the outer liner connecting flange and the outer dome connecting flange to restrict an airflow through the outer gap into the combustion chamber, and an inner seal member arranged to seal an inner gap between the inner liner connecting flange and the inner dome connecting flange to restrict an airflow through the inner gap into the combustion chamber.

The combustor according to the preceding clause, wherein the cowl structure has a single outer cowl connecting flange, and has a single inner cowl connecting flange.

The combustor according to any preceding clause, wherein the cowl structure has an outer connecting clevis that includes a first outer cowl connecting flange and a second outer cowl connecting flange, and has an inner connecting clevis that has a first inner cowl connecting flange and a second inner cowl connecting flange.

The combustor according to any preceding clause, wherein the at least one outer connection comprises an outer bolted joint, and the at least one inner connection comprises an inner bolted joint.

The combustor according to any preceding clause, wherein the inner bolted joint includes an inner liner bushing extending through an inner liner bushing opening through the inner liner connecting flange, an inner dome bushing extending through an inner dome bushing opening through the inner dome connecting flange, and an inner fastener extending through the inner liner bushing and through the inner dome bushing.

The combustor according to any preceding clause, wherein an inner side of the inner liner bushing is in contact with a bolt head on a first end of the inner fastener, an outer side of the inner liner bushing is in contact with an inner side of the inner cowl connecting flange, an inner side of the inner dome bushing is in contact with an outer side of the inner cowl connecting flange, and an outer side of the inner dome bushing is in contact with a nut connected to a second side of the inner fastener.

The combustor according to any preceding clause, wherein the outer bolted joint includes an outer liner bushing extending through an outer liner bushing opening through the outer liner connecting flange, an outer dome bushing extending through an outer dome bushing opening through the outer dome connecting flange, and an outer fastener extending through the outer liner bushing and through the outer dome bushing.

The combustor according to any preceding clause, wherein an outer side of the outer liner bushing is in contact with a bolt head on a first end of the outer fastener, an inner side of the outer liner bushing is in contact with an outer side of the outer cowl connecting flange, an outer side of the outer dome bushing is in contact with an inner side of the outer cowl connecting flange, and an inner side of the outer dome bushing is in contact with a nut connected to a second end of the outer fastener.

The combustor according to any preceding clause, wherein an outer seal cavity is defined between the outer liner connecting flange and the outer dome connecting flange, and the outer seal member is arranged within the outer seal cavity.

The combustor according to any preceding clause, wherein the outer seal member is in contact with an inner side of the outer liner connecting flange and with an outer side of the outer dome connecting flange.

The combustor according to any preceding clause, wherein the outer seal member comprises any one of a piston seal, a rope seal, a C-seal, a W-seal, brush seal, or a discourager.

The combustor according to any preceding clause, wherein outer seal member comprises a discourager and the discourager is connected to one of (a) the outer dome connecting flange and extends radially outward from an outer side of the outer dome connecting flange into the outer seal cavity, or (b) the outer liner connecting flange and extends radially inward from an inner side of the outer liner connecting flange into the outer seal cavity.

The combustor according to any preceding clause, wherein an inner seal cavity is defined between the inner liner connecting flange and the inner dome connecting flange, and the inner seal member is arranged within the inner seal cavity.

The combustor according to any preceding clause, wherein the inner seal member is in contact with an outer side of the inner liner connecting flange and with an inner side of the inner dome connecting flange.

The combustor according to any preceding clause, wherein the inner seal member comprises any one of a piston seal, a rope seal, a C-seal, a W-seal, brush seal, or a discourager.

The combustor according to any preceding clause, wherein the inner seal member comprises a discourager and the discourager is connected to one of (a) the inner dome connecting flange and extends radially inward from an inner side of the inner dome connecting flange into the inner seal cavity, or (b) the inner liner connecting flange and extends radially outward from an outer side of the inner liner connecting flange into the inner seal cavity.

The combustor according to any preceding clause, wherein the combustor is an annular combustor that extends annularly about a combustor centerline axis, the CMC outer liner is an annular outer liner, the CMC inner liner is an annular inner liner, the dome structure is an annular dome structure, the cowl structure is an annular cowl structure, the outer seal member extends annularly about the combustor centerline axis and the inner seal member extends annularly about the combustor centerline axis.

The combustor according to any preceding clause, wherein the at least one outer connection includes a plurality of outer connections circumferentially spaced apart about the combustor centerline axis, and the at least one inner connection includes a plurality of inner connections circumferentially spaced apart about the combustor centerline axis.

The combustor according to any preceding clause, wherein the plurality of outer connections are circumferentially spaced apart from one another by an angular amount with respect to the combustor centerline axis, and the plurality of inner connections are circumferentially spaced apart from one another by the angular amount with respect to the combustor centerline axis.

A gas turbine engine including a compressor section, a turbine section, and a combustion section that receives an airflow from the compressor section, the airflow being provided to a combustion chamber within a combustor of the combustion section, the combustor including (a) a ceramic matrix composite (CMC) dome structure including an outer dome connecting flange extending in a longitudinal direction, an inner dome connecting flange extending in the longitudinal direction, and dome plate extending between the outer dome connecting flange and the inner dome connecting flange, (b) a CMC outer liner including an outer liner connecting flange extending in the longitudinal direction, (c) a CMC inner liner including an inner liner connecting flange extending in the longitudinal direction, (d) a cowl structure including an outer cowl connecting flange extending in the longitudinal direction and an inner cowl connecting flange extending in the longitudinal direction, (e) at least one outer connection connecting the outer liner connecting flange, the outer cowl connecting flange, and the outer dome connecting flange, (f) at least one inner connection connecting the inner liner connecting flange, the inner cowl connecting flange, and the inner dome connecting flange, (g) an outer seal member arranged to seal an outer gap between the outer liner connecting flange and the outer dome connecting flange to restrict an airflow through the outer gap into the combustion chamber, and (h) an inner seal member arranged to seal an inner gap between the inner liner connecting flange and the inner dome connecting flange to restrict an airflow through the inner gap into the combustion chamber.

The gas turbine engine according to the preceding clause, wherein an outer seal cavity is defined between the outer liner connecting flange and the outer dome connecting flange, the outer seal member being arranged within the outer seal cavity, and an inner seal cavity is defined between the inner liner connecting flange and the inner dome connecting flange, the inner seal member being arranged within the inner seal cavity.

The gas turbine engine according to any preceding clause, wherein (i) the at least one outer connection comprises an outer bolted joint, and the at least one inner connection comprises an inner bolted joint, (ii) the outer bolted joint includes an outer liner bushing extending through an outer liner bushing opening through the outer liner connecting flange, an outer dome bushing extending through an outer dome bushing opening through the outer dome connecting flange, and an outer fastener extending through the outer liner bushing and through the outer dome bushing, and (iii) the inner bolted joint includes an inner liner bushing extending through an inner liner bushing opening through the inner liner connecting flange, an inner dome bushing extending through an inner dome bushing opening through the inner dome connecting flange, and an inner fastener extending through the inner liner bushing and through the inner dome bushing.

The gas turbine engine according to any preceding clause, wherein the cowl structure has a single outer cowl connecting flange, and has a single inner cowl connecting flange.

The gas turbine engine according to any preceding clause, wherein the cowl structure has an outer connecting clevis that includes a first outer cowl connecting flange and a second outer cowl connecting flange, and has an inner connecting clevis that has a first inner cowl connecting flange and a second inner cowl connecting flange.

The gas turbine engine according to any preceding clause, wherein the at least one outer connection comprises an outer bolted joint, and the at least one inner connection comprises an inner bolted joint.

The gas turbine engine according to any preceding clause, wherein the inner bolted joint includes an inner liner bushing extending through an inner liner bushing opening through the inner liner connecting flange, an inner dome bushing extending through an inner dome bushing opening through the inner dome connecting flange, and an inner fastener extending through the inner liner bushing and through the inner dome bushing.

The gas turbine engine according to any preceding clause, wherein an inner side of the inner liner bushing is in contact with a bolt head on a first end of the inner fastener, an outer side of the inner liner bushing is in contact with an inner side of the inner cowl connecting flange, an inner side of the inner dome bushing is in contact with an outer side of the inner cowl connecting flange, and an outer side of the inner dome bushing is in contact with a nut connected to a second end of the inner fastener.

The gas turbine engine according to any preceding clause, wherein the outer bolted joint includes an outer liner bushing extending through an outer liner bushing opening through the outer liner connecting flange, an outer dome bushing extending through an outer dome bushing opening through the outer dome connecting flange, and an outer fastener extending through the outer liner bushing and through the outer dome bushing.

The gas turbine engine according to any preceding clause, wherein an outer side of the outer liner bushing is in contact with a bolt head on a first end of the outer fastener, an inner side of the outer liner bushing is in contact with an outer side of the outer cowl connecting flange, an outer side of the outer dome bushing is in contact with an inner side of the outer cowl connecting flange, and an inner side of the outer dome bushing is in contact with a nut connected to a second end of the outer fastener.

The gas turbine engine according to any preceding clause, wherein an outer seal cavity is defined between the outer liner connecting flange and the outer dome connecting flange, and the outer seal member is arranged within the outer seal cavity.

The gas turbine engine according to any preceding clause, wherein the outer seal member is in contact with an inner side of the outer liner connecting flange and with an outer side of the outer dome connecting flange.

The gas turbine engine according to any preceding clause, wherein the outer seal member comprises any one of a piston seal, a rope seal, a C-seal, a W-seal, brush seal, or a discourager.

The gas turbine engine according to any preceding clause, wherein outer seal member comprises a discourager and the discourager is connected to one of (a) the outer dome connecting flange and extends radially outward from an outer side of the outer dome connecting flange into the outer seal cavity, or (b) the outer liner connecting flange and extends radially inward from an inner side of the outer liner connecting flange into the outer seal cavity.

The gas turbine engine according to any preceding clause, wherein an inner seal cavity is defined between the inner liner connecting flange and the inner dome connecting flange, and the inner seal member is arranged within the inner seal cavity.

The gas turbine engine according to any preceding clause, wherein the inner seal member is in contact with an outer side of the inner liner connecting flange and with an inner side of the inner dome connecting flange.

The gas turbine engine according to any preceding clause, wherein the inner seal member comprises any one of a piston seal, a rope seal, a C-seal, a W-seal, brush seal, or a discourager.

The gas turbine engine according to any preceding clause, wherein the inner seal member comprises a discourager and the discourager is connected to one of (a) the inner dome connecting flange and extends radially inward from an inner side of the inner dome connecting flange into the inner seal cavity, or (b) the inner liner connecting flange and extends radially outward from an outer side of the inner liner connecting flange into the inner seal cavity.

The gas turbine engine according to any preceding clause, wherein the combustor is an annular combustor that extends annularly about a combustor centerline axis, the CMC outer liner is an annular outer liner, the CMC inner liner is an annular inner liner, the dome structure is an annular dome structure, the cowl structure is an annular cowl structure, the outer seal member extends annularly about the combustor centerline axis and the inner seal member extends annularly about the combustor centerline axis.

The gas turbine engine according to any preceding clause, wherein the at least one outer connection includes a plurality of outer connections circumferentially spaced apart about the combustor centerline axis, and the at least one inner connection includes a plurality of inner connections circumferentially spaced apart about the combustor centerline axis.

The gas turbine engine according to any preceding clause, wherein the plurality of outer connections are circumferentially spaced apart from one another by an angular amount with respect to the combustor centerline axis, and the plurality of inner connections are circumferentially spaced apart from one another by the angular amount with respect to the combustor centerline axis.

Although the foregoing description is directed to some exemplary embodiments of the present disclosure, other variations and modifications will be apparent to those skilled in the art, and may be made without departing from the present disclosure. Moreover, features described in connection with one embodiment of the present disclosure may be used in conjunction with other embodiments, even if not explicitly stated above.

We claim:

1. A combustor for a gas turbine engine, the combustor receiving an airflow from a compressor section of the gas turbine engine, the airflow being provided to a combustion chamber within the combustor, the combustor comprising:

a ceramic matrix composite (CMC) dome structure including an outer dome connecting flange extending in a longitudinal direction, an inner dome connecting flange extending in the longitudinal direction, and dome plate extending between the outer dome connecting flange and the inner dome connecting flange;

a CMC outer liner including an outer liner connecting flange extending in the longitudinal direction;

a CMC inner liner including an inner liner connecting flange extending in the longitudinal direction;

a cowl structure including an outer cowl connecting flange extending in the longitudinal direction and an inner cowl connecting flange extending in the longitudinal direction;

at least one outer connection connecting the outer liner connecting flange, the outer cowl connecting flange, and the outer dome connecting flange;

at least one inner connection connecting the inner liner connecting flange, the inner cowl connecting flange, and the inner dome connecting flange, the at least one inner connection comprises an inner bolted joint including an inner liner bushing extending through an inner liner bushing opening through the inner liner connecting flange, an inner dome bushing extending through an inner dome bushing opening through the inner dome connecting flange, and an inner fastener extending through the inner liner bushing and through the inner dome bushing;

an outer seal member arranged to seal an outer gap between the outer liner connecting flange and the outer dome connecting flange to restrict an airflow through the outer gap into the combustion chamber; and an inner seal member arranged to seal an inner gap between the inner liner connecting flange and the inner dome connecting flange to restrict an airflow through the inner gap into the combustion chamber.

2. The combustor according to claim 1, wherein the cowl structure has a single outer cowl connecting flange, and has a single inner cowl connecting flange.

3. The combustor according to claim 1, wherein an inner side of the inner liner bushing is in contact with a bolt head on a first end of the inner fastener, an outer side of the inner liner bushing is in contact with an inner side of the inner cowl connecting flange, an inner side of the inner dome bushing is in contact with an outer side of the inner cowl connecting flange, and an outer side of the inner dome bushing is in contact with a nut connected to a second end of the inner fastener.

4. The combustor according to claim 1, wherein the at least one outer connection comprises an outer bolted joint including an outer liner bushing extending through an outer liner bushing opening through the outer liner connecting flange, an outer dome bushing extending through an outer dome bushing opening through the outer dome connecting flange, and an outer fastener extending through the outer liner bushing and through the outer dome bushing.

5. The combustor according to claim 4, wherein an outer side of the outer liner bushing is in contact with a bolt head on a first end of the outer fastener, an inner side of the outer liner bushing is in contact with an outer side of the outer cowl connecting flange, an outer side of the outer dome bushing is in contact with an inner side of the outer cowl connecting flange, and an inner side of the outer dome bushing is in contact with a nut connected to a second end of the outer fastener.

6. The combustor according to claim 1, wherein an outer seal cavity is defined between the outer liner connecting flange and the outer dome connecting flange, and the outer seal member is arranged within the outer seal cavity.

7. The combustor according to claim 6, wherein the outer seal member is in contact with an inner side of the outer liner connecting flange and with an outer side of the outer dome connecting flange.

8. The combustor according to claim 6, wherein the outer seal member comprises any one of a piston seal, a rope seal, a C-seal, a W-seal, a brush seal, or a discourager.

9. The combustor according to claim 6, wherein outer seal member comprises a discourager and the discourager is a part of one of (a) the outer dome connecting flange and extends radially outward from an outer side of the outer dome connecting flange into the outer seal cavity, or (b) the outer liner connecting flange and extends radially inward from an inner side of the outer liner connecting flange into the outer seal cavity.

10. The combustor according to claim 1, wherein an inner seal cavity is defined between the inner liner connecting flange and the inner dome connecting flange, and the inner seal member is arranged within the inner seal cavity.

11. The combustor according to claim 10, wherein the inner seal member is in contact with an outer side of the inner liner connecting flange and with an inner side of the inner dome connecting flange.

12. The combustor according to claim 10, wherein the inner seal member comprises any one of a piston seal, a rope seal, a C-seal, a W-seal, a brush seal, or a discourager.

13. The combustor according to claim 10, wherein the inner seal member comprises a discourager and the discourager is a part of one of (a) the inner dome connecting flange and extends radially inward from an inner side of the inner dome connecting flange into the inner seal cavity, or (b) the inner liner connecting flange and extends radially outward from an outer side of the inner liner connecting flange into the inner seal cavity.

14. The combustor according to claim 1, wherein the combustor is an annular combustor that extends annularly about a combustor centerline axis, the CMC outer liner is an annular outer liner, the CMC inner liner is an annular inner liner, the dome structure is an annular dome structure, the cowl structure is an annular cowl structure, the outer seal member extends annularly about the combustor centerline axis and the inner seal member extends annularly about the combustor centerline axis.

15. The combustor according to claim 14, wherein the at least one outer connection includes a plurality of outer connections circumferentially spaced apart about the combustor centerline axis, and the at least one inner connection includes a plurality of inner connections circumferentially spaced apart about the combustor centerline axis.

16. A gas turbine engine comprising:

a compressor section;

a turbine section; and a combustion section that receives an airflow from the compressor section, the airflow being provided to a combustion chamber within a combustor of the combustion section, the combustor comprising: (a) a ceramic matrix composite (CMC) dome structure including an outer dome connecting flange extending in a longitudinal direction, an inner dome connecting flange extending in the longitudinal direction, and dome plate extending between the outer dome connecting flange and the inner dome connecting flange, (b) a CMC outer liner including an outer liner connecting flange extending in the longitudinal direction, (c) a CMC inner liner including an inner liner connecting flange extending in the longitudinal direction, (d) a cowl structure including an outer cowl connecting flange extending in the longitudinal direction and an inner cowl connecting flange extending in the longitudinal direction, (e) at least one outer connection connecting the outer liner connecting flange, the outer cowl connecting flange, and the outer dome connecting flange, the at least one outer connection comprises an outer bolted joint including an outer liner bushing extending through an outer liner bushing opening through the outer liner connecting flange, an outer dome bushing extending through an outer dome bushing opening through the outer dome connecting flange, and an outer fastener extending through the outer liner bushing and through the outer dome bushing, (f) at least one inner connection connecting the inner liner connecting flange, the inner cowl connecting flange, and the inner dome connecting flange, (g) an outer seal member arranged to seal an outer gap between the outer liner connecting flange and the outer dome connecting flange to restrict an airflow through the outer gap into the combustion chamber, and (h) an inner seal member arranged to seal an inner gap between the inner liner connecting flange and the inner dome connecting flange to restrict an airflow through the inner gap into the combustion chamber.

17. The gas turbine engine according to claim 16, wherein an outer seal cavity is defined between the outer liner connecting flange and the outer dome connecting flange, the outer seal member being arranged within the outer seal cavity, and an inner seal cavity is defined between the inner liner connecting flange and the inner dome connecting flange, the inner seal member being arranged within the inner seal cavity.

18. The gas turbine engine according to claim 16, wherein the at least one inner connection comprises an inner bolted joint including an inner liner bushing extending through an inner liner bushing opening through the inner liner connecting flange, an inner dome bushing extending through an inner dome bushing opening through the inner dome connecting flange, and an inner fastener extending through the inner liner bushing and through the inner dome bushing.

* * * * *